US011462153B2

(12) United States Patent
Li et al.

(10) Patent No.: US 11,462,153 B2
(45) Date of Patent: Oct. 4, 2022

(54) CHANNEL-SCAN SWITCHABLE LED DRIVING

(71) Applicant: SCT LTD., Grand Cayman (KY)

(72) Inventors: Eric Li, Milpitas, CA (US); Jim Wickenhiser, Milpitas, CA (US); Yi Zhang, Milpitas, CA (US); Shang-Kuan Tang, Milpitas, CA (US); Shean-Yih Chiou, Milpitas, CA (US); Brandon Li, Milpitas, CA (US)

(73) Assignee: SCT LTD., Grand Cayman (KY)

( * ) Notice: Subject to any disclaimer, the term of this patent is extended or adjusted under 35 U.S.C. 154(b) by 0 days.

(21) Appl. No.: 17/556,775

(22) Filed: Dec. 20, 2021

(65) Prior Publication Data

US 2022/0114953 A1 Apr. 14, 2022

Related U.S. Application Data

(63) Continuation-in-part of application No. 17/398,603, filed on Aug. 10, 2021, now Pat. No. 11,409,163.

(60) Provisional application No. 63/127,675, filed on Dec. 18, 2020, provisional application No. 63/063,918, filed on Aug. 10, 2020.

(51) Int. Cl.
*G09G 3/32* (2016.01)

(52) U.S. Cl.
CPC ..... *G09G 3/32* (2013.01); *G09G 2310/0216* (2013.01); *G09G 2320/0247* (2013.01); *G09G 2320/0261* (2013.01)

(58) Field of Classification Search
CPC ..... H05B 45/32; H05B 45/325; H05B 45/40; H05B 45/46; G02F 1/133603; G02F 1/133612; G09G 3/34; G09G 3/36; G09G 3/3611; G09G 3/32; G09G 2310/0216; G09G 2320/0247; G09G 2320/0261
See application file for complete search history.

(56) References Cited

U.S. PATENT DOCUMENTS

| | | | | |
|---|---|---|---|---|
| 8,040,304 | B2 | 10/2011 | Huang et al. | |
| 8,378,939 | B2 | 2/2013 | Kimura | |
| 2006/0139256 | A1* | 6/2006 | Adachi | G09G 3/3216 345/76 |
| 2018/0174504 | A1* | 6/2018 | Yoneoka | G09G 3/2014 |

* cited by examiner

*Primary Examiner* — Jimmy T Vu
(74) *Attorney, Agent, or Firm* — Novick, Kim & Lee, PLLC; Allen Xue

(57) ABSTRACT

An LED display device includes an LED array and a driver system thereof. The LED display device is configured so that LEDs in the LED array can switch between receiving scan signals at their anodes or receiving scan signals at their cathodes.

20 Claims, 20 Drawing Sheets

Common Cathode Configuration

Common Anode Configuration

CHANNEL-SCAN SWITCHABLE LED DRIVING

CROSS-REFERENCE TO RELATED APPLICATIONS

This application is a continuation-in-part of U.S. application Ser. No. 17/398,603, filed Aug. 10, 2021, which claims the benefit of priority under 35 U.S.C. § 119 to U.S. Provisional Application No. 63/063,918, filed Aug. 10, 2020, and this application claims the benefit of priority under 35 U.S.C. § 119 to U.S. Provisional Application No. 63/127,675, filed on Dec. 18, 2020, the entire contents of which are incorporated herein by reference.

BACKGROUND

1. Field of Technology

This disclosure provides an LED array having an interleaved topology and a display panel using the interleaved LED array to provide backlight, as well as methods for arranging and operating the LED array and the display panel.

2. Description of Related Art

High end hand-held displays such as iPAD and iMac employ liquid crystal displays ("LCD") with light emitting diode ("LED") backlight panels. U.S. application Ser. No. 17/398,603, filed Aug. 10, 2021 (US '603), describes the characteristics of LCD display. For example, LCD pixels have a slow response time and are updated sequentially, causing a delay in updating all LCD pixels on the display. US '603 proposes a method of common delay for LCD backlighting using LED array, which is hereby incorporated in its entirety.

The LED backlight array has a large number of mini LEDs. A white LED pitch may be smaller than 2 mm in size. The light emitted from each LED passes through a diffuser to light the LCD. Each LCD pixel not only receives light from the LED right behind it, but also receives light from adjacent LEDs. Such cross-talking among nearby LED pixels may cause the blooming effect.

During operation, the LCD display has different requirements when displaying different contents. High speed video demands motion blur-free video images, which may be accomplished by the common delay scheme as disclosed in US '918. On the other hand, when displaying static images, it is important to reduce or eliminate flickering and blooming.

To obtain a flicker free screen, one may light LEDs at a high frequency, e.g., 100 Hz. As long as one of the LEDs around an LCD pixel is lit frequently enough, a viewer may not be see the flickering. For example, in a 2×2 LED pixel group, if each LED pixel can be lit once per frame, then LCD pixels located in front of the LED pixel group receive 4 separate light pulses within one frame so that flicker may be eliminated. On the other hand, to reduce the blooming effect requires reduction of stray light from neighboring LEDs. One way to accomplish the blooming effect is to allow fewer LEDs among a group LEDs emitting light. E.g., lighting only one LED among an 3×3 or 4×4 array of LED would reduce blooming.

Further, having a motion blur free screen demands a short and bright pulse per frame while no adjacent LEDs should be lit beyond this short pulse period. Therefore, accomplishing flicker-free and accomplishing blur-free require two different schemes. It is desirable that the LCD display can accomplish both, which requires a complex driver structure and a new driving scheme.

In addition, one of the challenges for a complex LED backlight system is the driver chip does not have space to accommodate the large amount of connections required to drive the LED array. Although one may reduce the number of connections by having one connection supplying multiple LEDs, e.g., 12 LEDs arranged into a mini 3×4 array, such a driving method does not allow control of individual LED pixels. Accordingly, there is a need for new method and devices to drive the LED array for backlighting a display panel.

SUMMARY

This disclosure provides systems and methods that allow the same driver to switch between an anti-blooming scan mode that reduces blooming and a strobe common delay mode that reduces motion blur. In particular, the proposed system for driving an LED array have connection pins are switchable between a current source (or a current sink) and a scan line. Such a design is hereby referred to as channel-scan-switching, while the switching device/circuit is referred to as a chancel-scan switch or CSS, which enables a significantly smaller number of connections to driver a large LED array and accomplish both blooming-less and motion blur-free display.

An LED display device includes an LED array and a driver system thereof. The LED display device is configured so that LEDs in the LED array can switch between receiving scan signals at their anodes or receiving scan signals at their cathodes.

According to some embodiments, the LED display device includes at least one display units, each of the at least one display units further comprises an LED array of L×M×N LEDs driven by N cores of channel scan switching, an anode side switching circuit for anode side channel scan switching with M×N current source analog inputs and M×N digital scan inputs, the anode side switching circuit is switchably connected to M×N current sources and M×N scan lines, a cathode side switching circuit for cathode side channel scan switching with M×N current sink analog inputs and M×N digital scan inputs, the cathode side switching circuit is switchably connected to M×N current sinks and M×N scan lines, a first selection circuit connected to M×N current sources and M×N scan lines, the first selection circuit is configured to select at least one current source from the M×N current sources and at least one scan line from the M×N scan lines in the anode side switching circuit, and a second selection circuit connected to M×N current sinks and M×N scan lines, the second selection circuit is configured to select at least one current sink from the M×N current sinks and at least one scan line from the M×N scan lines in the cathode side switching circuit.

According to some embodiments, the LED display device, one of the at least two modes of the controller is a static anti-blooming scan mode. The LED display device, the other one of the at least two modes of the controller is a strobe motion blur removal mode. The LED display device, when the first selection circuit and the second selection circuit are both switched to the static anti-blooming scan mode, all anodes are driven by the scan control inputs. The LED display device, when the first selection circuit and the second selection circuit are both switched to the strobe motion blur removal mode, all anodes are driven by the current source control inputs. The LED display device, when the first selection circuit and the second selection circuit are both switched to the static anti-blooming scan mode, CoreX cathodes are connected to corresponding CoreX channel current sink signals interleavedly. The LED display device when the first selection circuit and the second selection circuit are both switched to the strobe motion blur removal mode, CoreX cathodes are connected to corresponding CoreX scan signals interleavedly. The LED display device when the first selection circuit and the second selection circuit are both switched to the static anti-blooming scan mode, all cathodes are driven by the current sink control inputs. The LED display device when the first selection circuit and the second selection circuit are both switched to the strobe motion blur removal mode, all cathodes are driven by the scan control inputs. The LED display device, the LED display device common anode configuration. The LED display device, the LED display device common cathode configuration.

A method for controlling an LED display device switchable between at least two modes is disclosed. According to some embodiments, the method includes, deploying at least one display units, wherein each of the at least one display units further comprises an LED array of L×M×N LEDs driven by N cores of channel scan switching, deploying an anode side switching circuit for anode side channel scan switching with M×N current source analog inputs and M×N digital scan inputs by at least switchably connecting the anode side switching circuit with M×N current sources and M×N scan lines, deploying a cathode side switching circuit for cathode side channel scan switching with M×N current sink analog inputs and M×N digital scan inputs by at least switchably connecting the cathode side switching circuit with M×N current sinks and M×N scan lines, deploying a first selection circuit connected to M×N current sources and M×N scan lines by selecting at least one current source from the M×N current sources and at least one scan line from the M×N scan lines in the anode side switching circuit, and deploying a second selection circuit connected to M×N current sinks and M×N scan lines by selecting at least one current sink from the M×N current sinks and at least one scan line from the M×N scan lines in the cathode side switching circuit.

According to some embodiments, the method for controlling the LED display device further includes configuring the LED display device in a common anode configuration. The method further includes configuring the LED display device in a common cathode configuration. The method further includes driving all anodes with the scan control inputs when the first selection circuit and the second selection circuit are both switched to a static anti-blooming scan mode. The method further include driving all anodes with the current source control inputs when the first selection circuit and the second selection circuit are both switched to the strobe motion blur removal mode. The method further includes connecting CoreX cathodes to corresponding CoreX channel current sink signals interleavedly when the first selection circuit and the second selection circuit are both switched to the static anti-blooming scan mode. The method further includes connecting CoreX cathodes to corresponding CoreX scan signals interleavedly when the first selection circuit and the second selection circuit are both switched to the strobe motion blur removal mode. The method further includes driving all cathodes with the current sink control inputs when the first selection circuit and the second selection circuit are both switched to the static anti-blooming scan mode. The method further includes driving all cathodes with the scan control inputs when the first selection circuit and the second selection circuit are both switched to the strobe motion blur removal mode.

BRIEF DESCRIPTION OF DRAWINGS

The teachings of the present invention can be readily understood by considering the following detailed description in conjunction with the accompanying drawings.

FIGS. 1 through 8 illustrate the topology of the system having the LED array arranged in a common cathode configuration. In comparison, FIGS. 9 through 14B are figures illustrating the topology of the system having LED array arranged in a common anode configuration. In general, the LED array has a plurality of rows and columns of LEDs. Used herein, an LED may refer to a white LED. However, the device and driving method disclosed herein are applicable to any single-color LEDs. In a common cathode configuration, each of LEDs in a row has its cathode connected to a single cathode node, which may be further connected to one or more scan switch, while anodes of LEDs in a channel are connected to a power source. In contrast, in a common anode configuration, anodes of LEDs in a row are connected to a common power source while cathodes of LEDs in a column are connected to a current sink, e.g., ground, or "GND".

FIG. 1 and FIG. 9 illustrate two topologies that share similarities, the difference is that FIG. 1 is in the common cathode configuration while FIG. 9 is in the common anode configuration. Similarly, FIGS. 2A, 2B and FIGS. 10A, 10B illustrate similar structures, the difference is that FIGS. 2A, 2B are in the common cathode configuration, while FIGS. 10A and 10B are in the common anode configuration. Likewise, FIGS. 3-5, 7A and 7B correspond to FIGS. 11-13, 14A and 14B, respectively. A component in the common anode configuration is sometime named with the suffix of "CA" or "_CA" attached to the name of a corresponding component in a common cathode configuration.

FIG. 1 illustrates an embodiment of the LED array arranged in the common cathode configuration.

FIGS. 2A and 2B illustrate examples of anode side channel scan switch on 32×32 cores core0 through core3 in the common cathode configuration illustrated in FIG. 1.

FIG. 3 illustrates an example of the CSS_32×32×4 LED block in the common cathode configuration illustrated in FIG. 1.

FIG. 5 illustrates an example of CSS_32×1 common cathode interleave switching element.

FIG. 6 illustrates an example of the channel scan switch for 8 anode pins in the common cathode configuration illustrated in FIG. 1.

FIG. 8 illustrates an example of the channel scan switch for 8 cathode pins in the common anode configuration illustrated in FIG. 1.

FIG. 9 illustrates an embodiment of the LED array arranged in the common anode configuration.

FIGS. 10A and 10B illustrate examples of cathode side channel scan switch on 32×32 cores core0 through core3 in the common anode configuration illustrated in FIG. 9.

FIG. 11 illustrates an example of the CSS_32×32×4 LED block in the common anode configuration illustrated in FIG. 9.

FIG. 13 illustrates an example of CSS_32×1 common anode interleave switching element.

FIGS. 14A and 14B illustrate examples of cathode side channel scan switch on 32×32 cores core0 through core3 in the common anode configuration illustrated in FIG. 9.

DETAILED DESCRIPTION

The following detailed description is provided to assist the reader in gaining a comprehensive understanding of the methods, apparatuses, and/or systems described herein. However, various changes, modifications, and equivalents of the systems, apparatuses, and/or methods described herein will be apparent to one of ordinary skill in the art. For example, the words "connection" and "pin" are used interchangeably in this disclosure, both denoting a physical link and/or a point on the physical link between two devices. "Driver chip" and "driver circuit" are used interchangeably. Further, $I_{source}$ ("Isrouce") refers to a current source while $I_{sink}$ ("Isink") refers to a current sink in a driver circuit. "Scan" or "scan line" both refer to a scan line in the driver circuit. Used herein, the term "core" refers to a driver circuit disposed on a driver chip. A driver chip may have one or more cores.

The features described herein may be embodied in different forms and are not to be construed as being limited to the examples described herein. Rather, the examples described herein have been provided so that this disclosure will be thorough and complete, and will convey the full scope of the disclosure to one of ordinary skill in the art.

Figure 1:
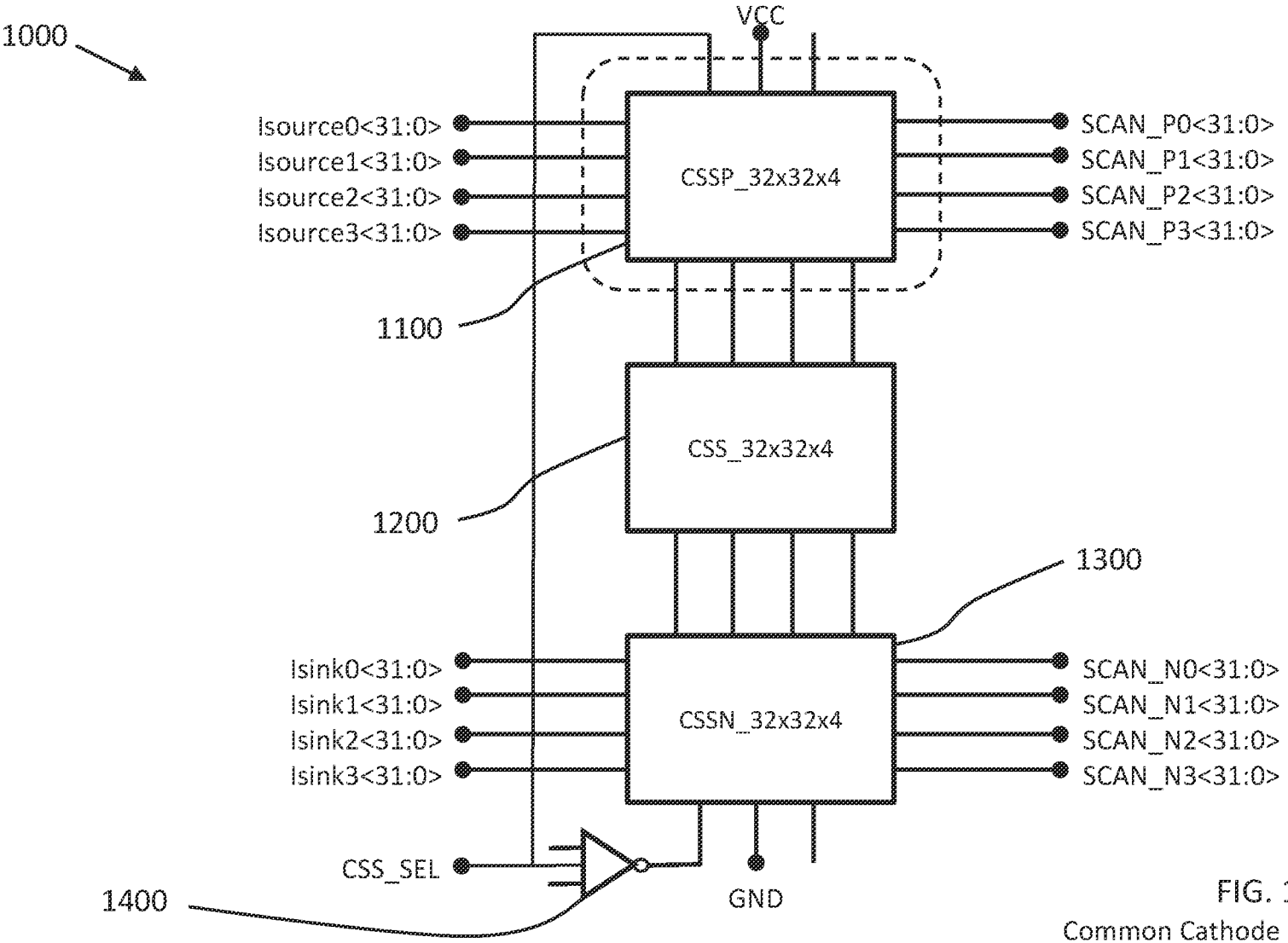

FIG. 1 illustrates three interconnected blocks: a L×M×N LED array block 1200, an anode block 1100 (CSSP_L×M×N) having 128 anode pins, a cathode block 1300 (CSSN_L×M×N) having 128 cathode pins to the LED array block 1200 (CSS_L×M×N). According to some embodiments, L=M, according to other embodiments, L≠M. As an example, illustrated in FIG. 1, L=M=32, N=4. The driver system 1000 also includes a controller 1400 (CSS_SEL), a voltage power source (VCC), and a ground (GND).

The anode block 1100 has 32×4 current source analog inputs and 32×4 digital scan inputs. For example, the 32×4 current source analog inputs are: Isource0<31:0>, Isource1<31:0>, Isource2<31:0>, Isource3<31:0>; Isource0<30:0>, Isource1<30:0>, Isource2<30:0>, Isource3<30:0>; Isource0<29:0>, Isource1<29:0>, Isource2<29:0>, Isource3<29:0>; . . . Isource0<1:0>, Isource1<1:0>, Isource2<1:0>, Isource3<1:0>; Isource0<0:0>, Isource1<0:0>, Isource2<0:0>, Isource3<0:0>, respectively. The 32×4 digital scan inputs are: SCAN_P0<31:0>, SCAN_P1<31:0>, SCAN_P2<31:0>, SCAN_P3<31:0>; SCAN_P0<30:0>, SCAN_P1<30:0>, SCAN_P2<30:0>, SCAN_P3<30:0>; SCAN_P0<29:0>, SCAN_P1<29:0>, SCAN_P2<29:0>, SCAN_P3<29:0>; . . . SCAN_P0<1:0>, SCAN_P1<1:0>, SCAN_P2<1:0>, SCAN_P3<1:0>; SCAN_P0<0:0>, SCAN_P1<0:0>, SCAN_P2<0:0>, SCAN_P3<0:0>, respectively.

The cathode block 1300 is a cathode side channel switching block having 32×4 current sink analog inputs and 32×4 digital scan inputs. The 32×4 current sink analog inputs are: Isink0<31:0>, Isink1<31:0>, Isink2<31:0>, Isink3<31:0>; Isink0<30:0>, Isink1<30:0>, Isink2<30:0>, Isink3<30:0>; Isink0<29:0>, Isink1<29:0>, Isink2<29:0>, Isink3<29:0>; . . . Isink0<1:0>, Isink1<1:0>, Isink2<1:0>, Isink3<1:0>; Isink0<0:0>, Isink1<0:0>, Isink2<0:0>, Isink3<0:0>, respectively. The 32×4 digital scan inputs are: SCAN_N0<31:0>, SCAN_N1<31:0>, SCAN_N2<31:0>, SCAN_N3<31:0>; SCAN_N0<30:0>, SCAN_N1<30:0>, SCAN_N2<30:0>, SCAN_N3<30:0>; SCAN_N0<29:0>, SCAN_N1<29:0>, SCAN_N2<29:0>, SCAN_N3<29:0>; . . . SCAN_N0<1:0>, SCAN_N1<1:0>, SCAN_N2<1:0>, SCAN_N3<1:0>; SCAN_N0<0:0>, SCAN_N1<0:0>, SCAN_N2<0:0>, SCAN_N3<0:0>, respectively.

The driver system 1000 includes an LED array block 1200 with 32×128 (i.e., 32×32×4=4,096) LEDs driven by 4 cores of channel scan switching circuit, each driving a 32×32 (32-channel by 32-scan lines) matrix. The LED array block 1200 includes 128 virtual cathode pins and there is a total of 256 pins to drive 32×32×4=4096 LEDs.

The controller 1400 is a relay circuit. As described below, the relay circuit 1400 enables switching between a static anti-blooming scan mode ("scan mode" in short) and a strobe common delay mode (or strobe motion blur removal mode, or "strobe mode" in short). According to an embodiment in this disclosure, when CSS_SEL=1, the system 1000 is switched into the scan mode; when CSS_SEL=0, the system 1000 is switched into the strobe mode. This configuration allows the anode pins in the anode block 1100 to switch between the state of being connected with the current sources (i.e., Isource0<31:0>, Isource1<31:0>, Isource2<31:0>, Isource3<31:0>, etc.) and the state of being connected with the scan lines (i.e., SCAN_P0<31:0>, SCAN_P1<31:0>, SCAN_P2<31:0>, SCAN_P3<31:0>, etc.). Likewise, the cathode pins in the cathode block 1300 are switchably connected with the current sinks (i.e., Isink0<31:0>, Isink1<31:0>, Isink2<31:0>, Isink3<31:0>, etc.) and the scan lines (i.e., SCAN_N0<31:0>, SCAN_N1<31:0>, SCAN_N2<31:0>, SCAN_N3<31:0>, etc.). The switching actions are properly timed so that 256 pins are needed for driving the array of 4,096 LEDs in the scan mode and the strobe mode. Accordingly, each pin serves two functions, thereby reducing the number of pins to one half of the pins required in a conventional design when each pin is designated to receive the digital scan signals or to receive the analog current signals.

Figure 2A:
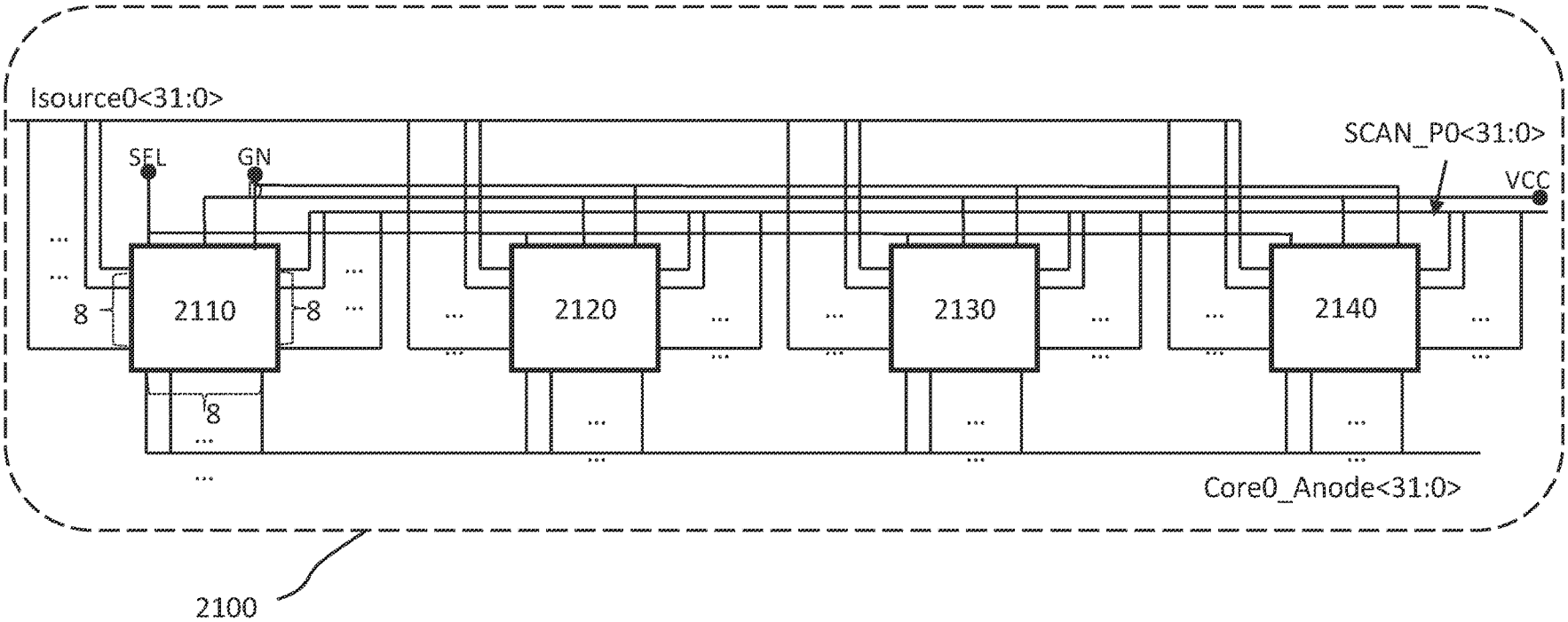
Figure 2B:
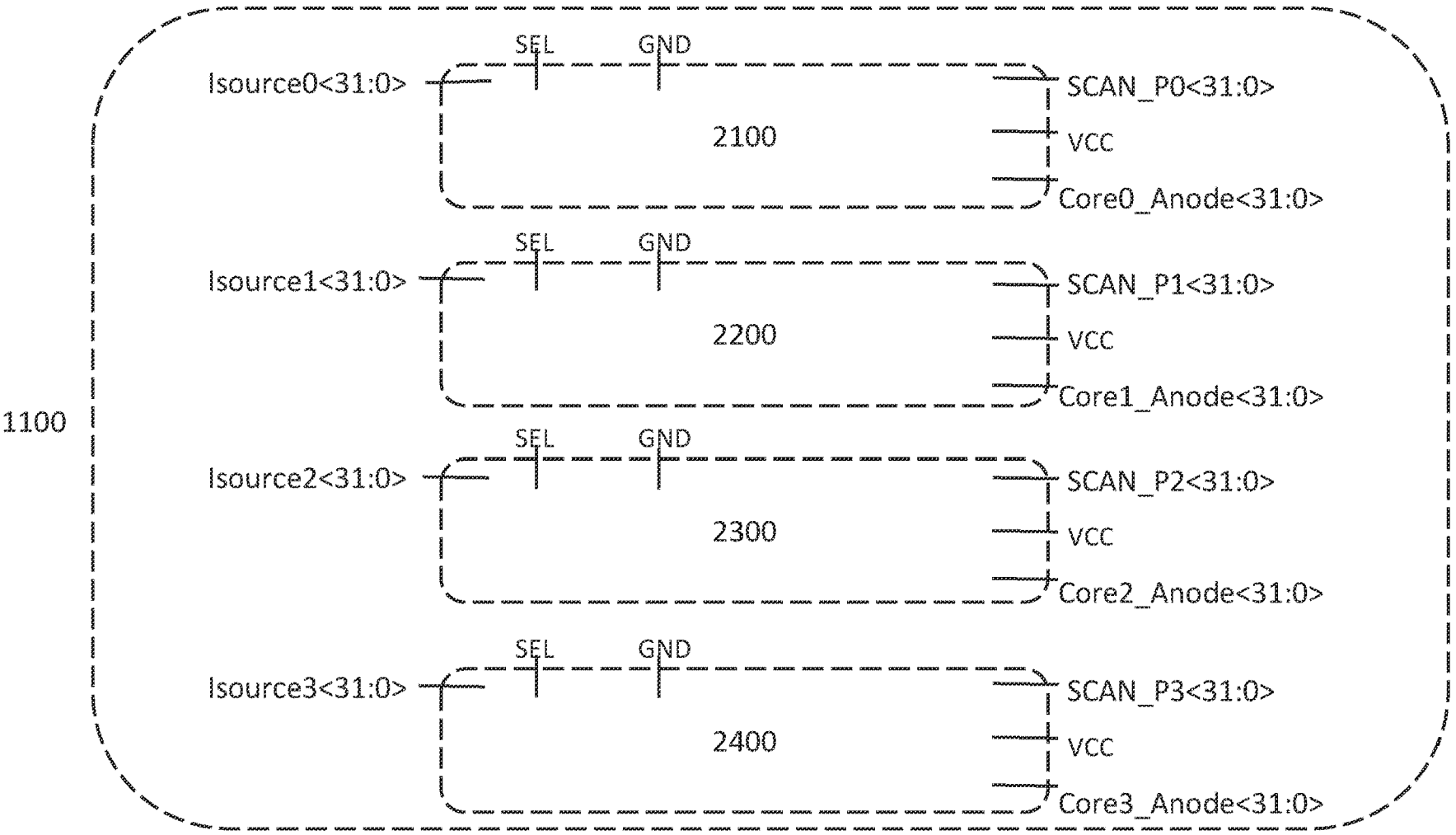

FIGS. 2A and 2B provide details of the anode side CSS control block 1100 in FIG. 1. The anode block 1100, or the anode side CSS control block 1100, has 4 cores of 32×32 anode side channel scan switching circuits, core0 is designated as 2100, core1 as 2200, core2 as 2300 and core3 as 2400, respectively, as illustrated in FIG. 2B. Each of the four cores, core0 to core3, is substantially of the same structure. In FIG. 2A, for example, the first core, or core0, 2100 includes one group of 32 digital scan inputs—SCAN_P0<31:0> to SCAN_P0<0:0>, one group of 32 analog current source control inputs—Isource0<31:0> to Isource0<0:0>, and one group of 32 anode output—Core0_Anode<31:0> to Core0_Anode<0:0>, which are grouped into four sub-units 2110, 2120, 2130, and 2140, respectively.

Each of the sub-units 2110 to 2140 includes 8 analog current source control inputs IsourceX<m:n>, where for example, X=0, 1, 2, 3, m=0-31, and n=0-31, 8 digital scan inputs SCAN_PX'<m':n'>, where for example, X'=0, 1, 2, 3, m'=0-31, and n'=0-31, and 8 anode outputs CoreX"_Anode<m":n">, where for example, X"=0, 1, 2, 3, m"=0-31, and n"=0-31. Each of the 8 analog current sources control input IsourceX<m:n> of each of the sub-units 2110 to 2140 is connected to one of 32 current sources—Isource0<31:0>. Each of the 8 digital scan input signals SCAN_PX'<m':n'> of each of the sub-units 2110 to 2140 are connected to one of 32 scan inputs—SCAN_P0<31:0>. Each of the sub-units 2110 to 2140 have 8 anode pins, providing a total of 32 anode pins in Core® for connecting to the LED array block 1200. All of the sub-units 2110 to 2140 are connected to one voltage power source—VCC, to one current sink—GND, and to one input pin—SEL.

Cores 2200, 2300 and 2400 have the substantially same structure as that of 2100. For example, core1 2200's inputs/outputs are correspondingly named as Isource1<31:0>, SCAN_P1<31:0>, and Core1_Anode<31:0>. Core2 2300's inputs/outputs are correspondingly named as Isource2<31:0>, SCAN_P2<31:0>, and Core2_Anode<31:0>. For example, core3 2400's inputs/outputs are correspondingly named as Isource3<31:0>, SCAN_P3<31:0> and Core3_Anode<31:0>.

In order to reduce blooming, digital scan inputs are arranged in a way outlined in Table 1 below to light only one LED is on at any given time in the group of 32 adjacent LEDs in the LED array 1200. In the strobe mode, all nodes are driven by current source control inputs. Anode pin connection sequence is the same as the current source sequence, i.e., CoreX"_Anode<31:0>=IsourceX<31:0>. The common delay scheme disclosed in US '603 can be applied in the strobe mode.

In the scan mode, LED anodes are driven by scan control inputs. Assignments of anode pins in the scan mode are detailed below, as well as in Table 1 in this application.

Core0 static anti-blooming scan pin assignment:
Core0_Anode<31>=SCAN_P0<31>
Core0_Anode<30>=SCAN_P0<15>
Core0_Anode<29>=SCAN_P0<23>
Core0_Anode<28>=SCAN_P0<7>
Core0_Anode<27>=SCAN_P0<30>
Core0_Anode<26>=SCAN_P0<14>
Core0_Anode<25>=SCAN_P0<22>
Core0_Anode<24>=SCAN_P0<6>
Core0_Anode<23>=SCAN_P0<29>
Core0_Anode<22>=SCAN_P0<13>
Core0_Anode<21>=SCAN_P0<21>
Core0_Anode<20>=SCAN_P0<5>
Core0_Anode<19>=SCAN_P0<28>
Core0_Anode<18>=SCAN_P0<12>
Core0_Anode<17>=SCAN_P0<20>
Core0_Anode<16>=SCAN_P0<4>
Core0_Anode<15>=SCAN_P0<27>
Core0_Anode<14>=SCAN_P0<11>
Core0_Anode<13>=SCAN_P0<19>
Core0_Anode<12>=SCAN_P0<3>
Core0_Anode<11>=SCAN_P0<26>
Core0_Anode<10>=SCAN_P0<10>
Core0_Anode<9>=SCAN_P0<18>
Core0_Anode<8>=SCAN_P0<2>
Core0_Anode<7>=SCAN_P0<25>
Core0_Anode<6>=SCAN_P0<9>
Core0_Anode<5>=SCAN_P0<17>
Core0_Anode<4>=SCAN_P0<1>
Core0_Anode<3>=SCAN_P0<24>
Core0_Anode<2>=SCAN_P0<8>
Core0_Anode<1>=SCAN_P0<16>
Core0_Anode<0>=SCAN_P0<0>.

Core1 static anti-blooming scan pin assignment:
Core1_Anode<31>=SCAN_P0<25>
Core1_Anode<30>=SCAN_P0<9>
Core1_Anode<29>=SCAN_P0<1>
Core1_Anode<28>=SCAN_P0<17>
Core1_Anode<27>=SCAN_P0<24>
Core1_Anode<26>=SCAN_P0<8>
Core1_Anode<25>=SCAN_P0<0>
Core1_Anode<24>=SCAN_P0<16>
Core1_Anode<23>=SCAN_P0<23>
Core1_Anode<22>=SCAN_P0<7>
Core1_Anode<21>=SCAN_P0<31>
Core1_Anode<20>=SCAN_P0<15>
Core1_Anode<19>=SCAN_P0<22>
Core1_Anode<18>=SCAN_P0<6>
Core1_Anode<17>=SCAN_P0<30>
Core1_Anode<16>=SCAN_P0<14>
Core1_Anode<15>=SCAN_P0<21>
Core1_Anode<14>=SCAN_P0<5>
Core1_Anode<13>=SCAN_P0<29>
Core1_Anode<12>=SCAN_P0<13>
Core1_Anode<11>=SCAN_P0<20>
Core1_Anode<10>=SCAN_P0<4>
Core1_Anode<9>=SCAN_P0<28>
Core1_Anode<8>=SCAN_P0<12>
Core1_Anode<7>=SCAN_P0<19>
Core1_Anode<6>=SCAN_P0<3>
Core1_Anode<5>=SCAN_P0<27>
Core1_Anode<4>=SCAN_P0<11>
Core1_Anode<3>=SCAN_P0<18>
Core1_Anode<2>=SCAN_P0<2>
Core1_Anode<1>=SCAN_P0<26>
Core1_Anode<0>=SCAN_P0<10>.

Core2 static anti-blooming scan pin assignment:
Core2_Anode<31>=SCAN_P0<19>
Core2_Anode<30>=SCAN_P0<3>
Core2_Anode<29>=SCAN_P0<11>
Core2_Anode<28>=SCAN_P0<27>
Core2_Anode<27>=SCAN_P0<18>
Core2_Anode<26>=SCAN_P0<2>
Core2_Anode<25>=SCAN_P0<10>
Core2_Anode<24>=SCAN_P0<26>
Core2_Anode<23>=SCAN_P0<17>
Core2_Anode<22>=SCAN_P0<1>
Core2_Anode<21>=SCAN_P0<9>
Core2_Anode<20>=SCAN_P0<25>
Core2_Anode<19>=SCAN_P0<16>
Core2_Anode<18>=SCAN_P0<0>
Core2_Anode<17>=SCAN_P0<8>
Core2_Anode<16>=SCAN_P0<24>
Core2_Anode<15>=SCAN_P0<15>
Core2_Anode<14>=SCAN_P0<31>
Core2_Anode<13>=SCAN_P0<7>
Core2_Anode<12>=SCAN_P0<23>
Core2_Anode<11>=SCAN_P0<14>
Core2_Anode<10>=SCAN_P0<30>
Core2_Anode<9>=SCAN_P0<6>
Core2_Anode<8>=SCAN_P0<22>
Core2_Anode<7>=SCAN_P0<13>
Core2_Anode<6>=SCAN_P0<29>
Core2_Anode<5>=SCAN_P0<5>
Core2_Anode<4>=SCAN_P0<21>
Core2_Anode<3>=SCAN_P0<12>
Core2_Anode<2>=SCAN_P0<28>
Core2_Anode<1>=SCAN_P0<4>
Core2_Anode<0>=SCAN_P0<20>.

Core3 static anti-blooming scan pin assignment:
Core3_Anode<31>=SCAN_P0<13>
Core3_Anode<30>=SCAN_P0<29>
Core3_Anode<29>=SCAN_P0<21>
Core3_Anode<28>=SCAN_P0<5>
Core3_Anode<27>=SCAN_P0<12>
Core3_Anode<26>=SCAN_P0<28>
Core3_Anode<25>=SCAN_P0<20>
Core3_Anode<24>=SCAN_P0<4>
Core3_Anode<23>=SCAN_P0<11>

Core3_Anode<22>=SCAN_P0<27>
Core3_Anode<21>=SCAN_P0<19>
Core3_Anode<20>=SCAN_P0<3>
Core3_Anode<19>=SCAN_P0<10>
Core3_Anode<18>=SCAN_P0<26>
Core3_Anode<17>=SCAN_P0<18>
Core3_Anode<16>=SCAN_P0<2>
Core3_Anode<15>=SCAN_P0<9>
Core3_Anode<14>=SCAN_P0<25>
Core3_Anode<13>=SCAN_P0<17>
Core3_Anode<12>=SCAN_P0<1>
Core3_Anode<11>=SCAN_P0<8>
Core3_Anode<10>=SCAN_P0<24>
Core3_Anode<9>=SCAN_P0<16>
Core3_Anode<8>=SCAN_P0<0>
Core3_Anode<7>=SCAN_P0<7>
Core3_Anode<6>=SCAN_P0<23>
Core3_Anode<5>=SCAN_P0<15>
Core3_Anode<4>=SCAN_P0<31>
Core3_Anode<3>=SCAN_P0<6>
Core3_Anode<2>=SCAN_P0<22>
Core3_Anode<1>=SCAN_P0<14>
Core3_Anode<0>=SCAN_P0<30>.

The 32 pins in each of CoreX"_Anode<31:0> are connected to a matrix of 32×32 LEDs, only one pin receives a scan digital signal at one time so that only one in 32 LEDs is lit at any given time, thus reducing blooming.

Figure 3:
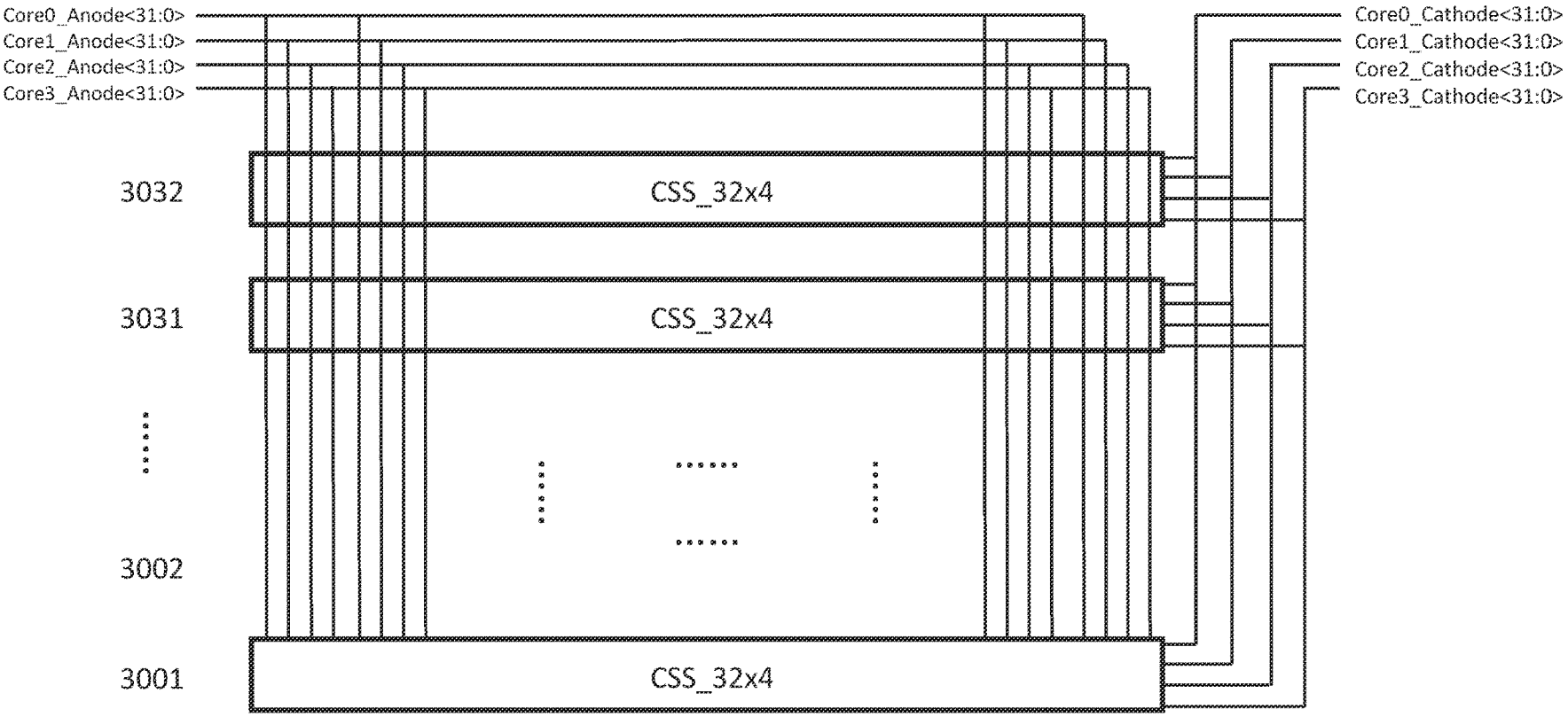

FIG. 3 illustrates an embodiment of the LED array block 1200 in the common cathode configuration illustrated in FIG. 1. It consists of thirty-two 32×4 sub blocks CSS_32×4, namely 3001, 3002, . . . 3031 and 3032, 128 anode pins from 4 cores—2100, 2200, 2300, and 2400—are connected to each sub block in an interleaved fashion, and the 4 cathode pins (one each from different 4 cores of CSSN_32×32×4) are connected to each sub block at a total of 128 cathode pins. Note that "interleaved fashion," "interleaved," "interleaving," or "interleavedly" refer to the arrangement in which a number connections are distributed out of order to a group of receiving members rather than being arranged in a consecutive fashion. For example, four pins A, B, C, D are to be connected to lines 1-16 arranged side-by-side in that order at 4 lines per pin. One may connect Pin A to lines 1-4, Pin B to lines 5-8, Pin C to lines 9-12, and Pin D to lines 13-16. In an interleaved fashion, Pin A may be connected to lines 1, 5, 9, 13, Pin B to lines 2, 6, 10, 14, Pin C to lines 3, 7, 11, and 15, which Pin D to lines 4, 8, 12, and 16. As shown in FIG. 3, each of the 32 anode outputs from Core0_Anode<31:0> is connected to one row in each of the sub-blocks 3001 to 3032.

In the cathode side strobe common delay mode, the CoreX cathodes are connected to the CoreX scan signals interleavedly. In the Cathode side static anti-blooming mode, the CoreX cathodes are connected to the CoreX channel current sink signals interleavedly.

The CSS_32×32×4 common cathode channel scan switching array includes 32 blocks of 32×4 interleave sub arrays. The same anode of each block is connected together with a total of 128 connections. There are four cathode pins assigned to each block and different cathodes are driven by different cores interleavedly. A total of 128 cathode connections drive a total 32 of blocks. Accordingly, the entire LED array includes a total of 4096 LEDs controlled by a total of 256 signals.

Figure 4A:
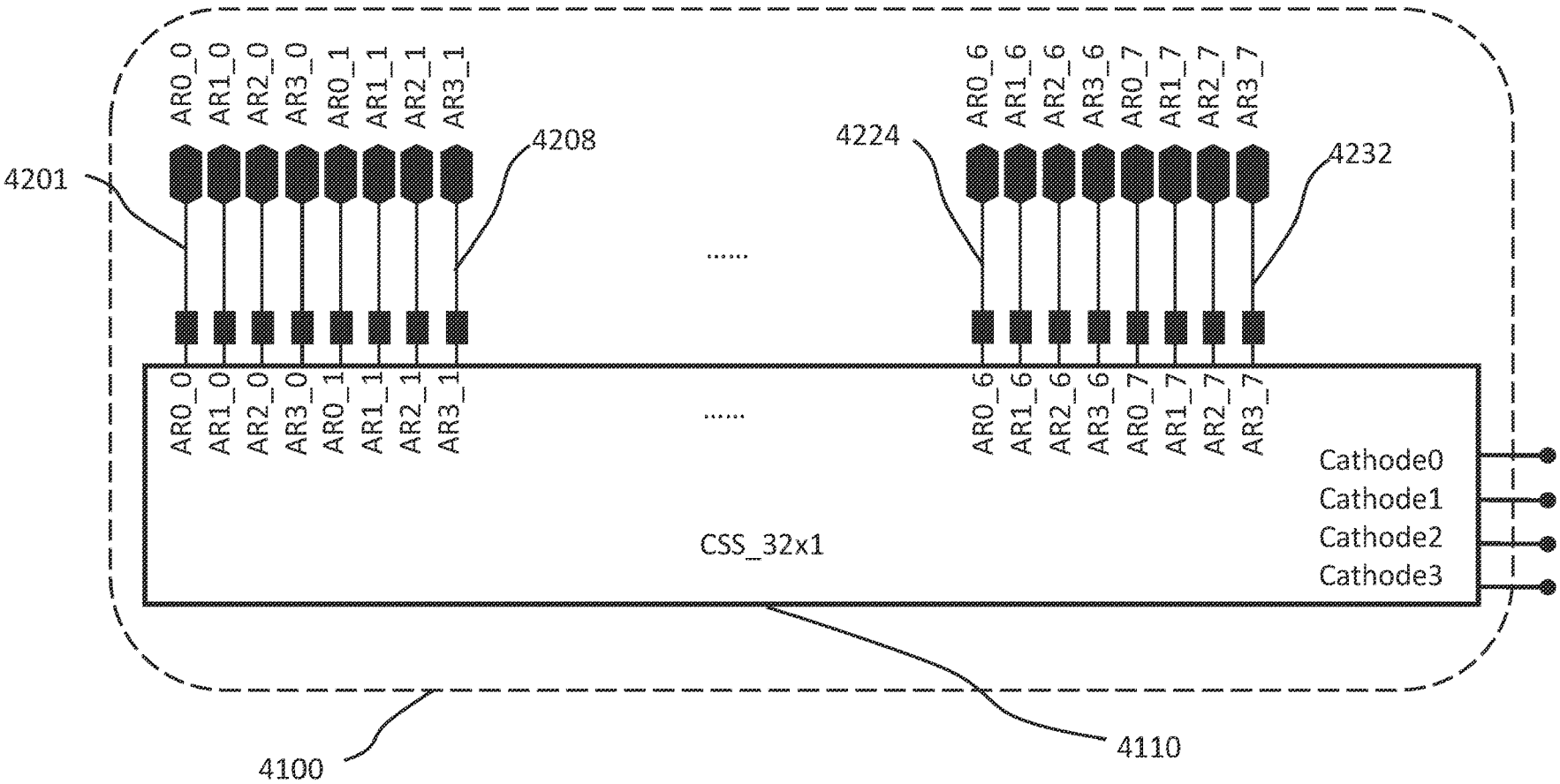
FIGS. 4A and 4B illustrate an example of CSS_32×4 common cathode interleave structure.
Figure 4B:
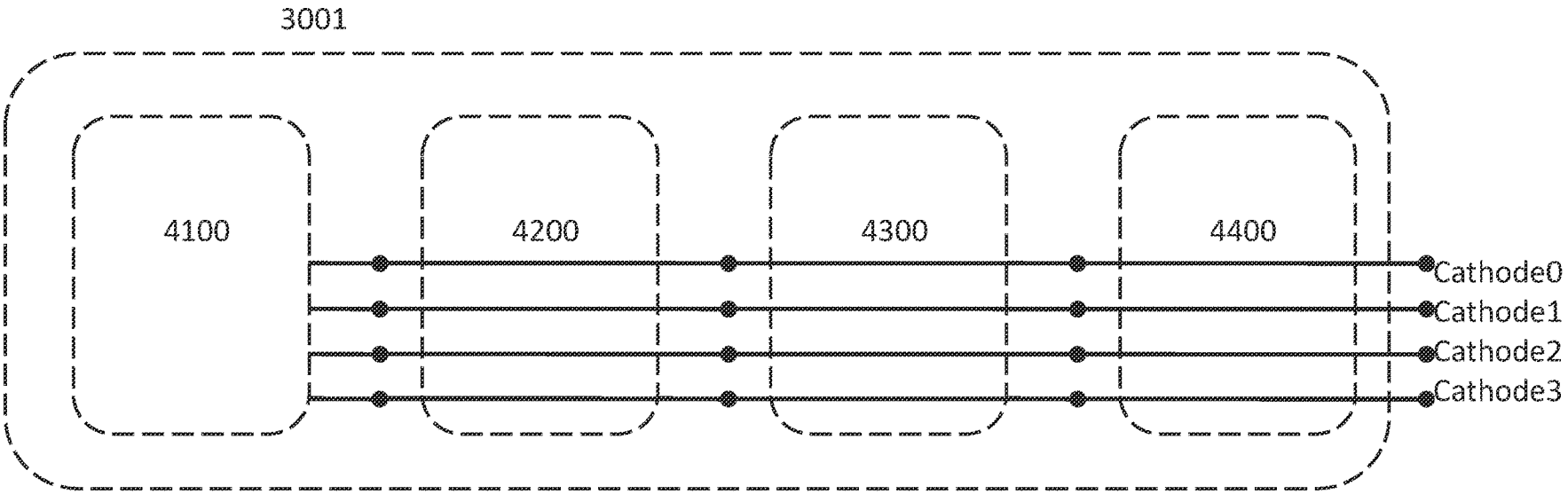

FIG. 4A illustrates an example of a base LED array 4100 (CSS_32×1) while FIG. 4B illustrates four base LED arrays 4100, 4200, 4300 and 4400. The base LED arrays have substantially the same structure. FIG. 4A shows further details in sub block 3001 in FIG. 3. The base LED array 4100 has 32 rows of LEDs and receives 32 anode inputs, eight inputs each from Core0-3_Anode, forming a total 32 anode connections: AR0_0, AR1_0, AR2_0, AR3_0, AR0_1, AR1_1, AR2_1, AR3_1, . . . AR0_7, AR1_7, AR2_7, AR3_7, or 4210, 4202, 4203, 4204, . . . 4232, respectively.

Further, as shown in FIG. 4A, the base LED array 4100 are connected to 4 cathode pins Cathode0, Cathode1, Cathode2, and Cathode3. Indeed, each of the base LED arrays namely, 4100, 4200, 4300 and 4400, are connected to cathode pins Cathode0, Cathode1, Cathode2, and Cathode3, as illustrated in FIG. 4B.

Figure 5:
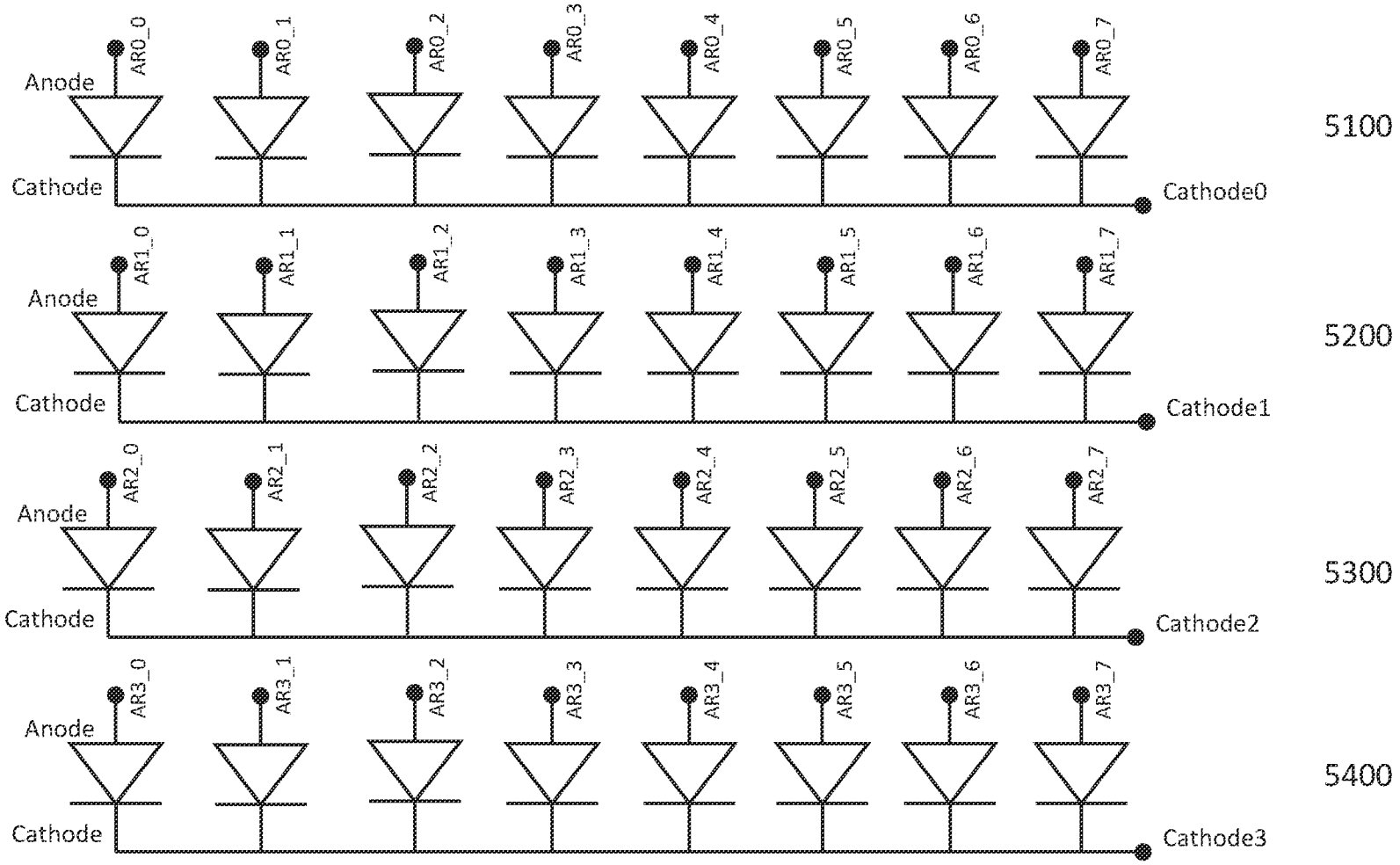

FIG. 5 illustrates one embodiment of the base LED arrays depicted in FIG. 4A or 4B, which consists of 32 LEDs arranged in 4 rows, namely, rows 5100, 5200, 5300 and 5400. In each row, eight LEDs are deployed with 8 anode connections and one common cathode connection. Specifically, the eight anodes of the eight LEDs in the first row 5100 receive AR0_0, AR0_1, AR0_2, AR0_3, AR0_4, AR0_5, AR0_6, and AR0_7, respectively, from Core0_Anode, while common cathode of the eight LEDs in the first row 5100 is cathode0. The eight anodes of the eight LEDs in the second row 5200 receive AR1_0, AR1_1, AR1_2, AR1_3, AR1_4, AR1_5, AR1_6, and AR1_7, respectively, from Core1_Anode, while the common cathode of the eight LEDs in the second row 5200 is cathode1. The eight anodes of the eight LEDs in the third row 5300 receive AR2_0, AR2_1, AR2_2, AR2_3, AR2_4, AR2_5, AR2_6, and AR2_7, respectively, from Core3_Anode, while the common cathode of the eight LEDs in the third row 5300 is cathode2, and so on. Control signals from four cores achieve both scan and strobe mode operation by channel scan switching in driver circuitry in CSSP_32×32×4 1100 and CSSN_32×32×4 blocks 1300 illustrated in FIG. 1 above.

In other words, one base LED array is arranged into 4 rows 5100, 5200, 5300 and 5400, each having 8 LEDs, for example, AR0_0 through AR0_7 in the first row 5100, AR1_0 through AR1_7 in the second row 5200, AR2_0 through AR2_7 in the third row 5300, AR3_0 through AR3_7 in the fourth row 5400. Cathodes of LEDs in each row are connected to a common cathode pin, for example, Cathode0 through Cathode4. Anodes of the LEDs in four rows (designated as anode rows ARX_Y, X=0, 1, or 3, Y=0-7) are connected to four different anode cores, Core0_Anode, Core1_Anode, Core1 Anode, Core3_Anode in an interleaved fashion. Anodes of the first row of LEDs (AR0_Y) are connected to Core0_Anode<0-7>; the anodes of the second row of LEDs (AR1_n) are connected to Core1_Anode<0-7>; the anodes of the third row of LEDs (AR2_n) are connected to Core2_Anode<0-7>; and the anodes of the forth row of LEDs (AR3_n) are connected to Core3_Anode<0-7>.

Likewise, each of the three other base LED arrays in the sub-array of FIGS. 4A and 4B are connected to CoreX<8-15>, CoreX<16-23>, and CoreX<23-31>, respectively. In the strobe mode, CathodeX is driven by cathode CoreX scan signal (Scan_NX<31:0>), while anodes ARX_Y is driven by the corresponding current source IsourceX<31:0>. In the scan mode, CathodeX is driven by cathode CoreX current sink (IsinkX<31:0>) while ARX_Y is driven by anode CoreX scan signals (Scan_PX<31:0>).

Figure 6:
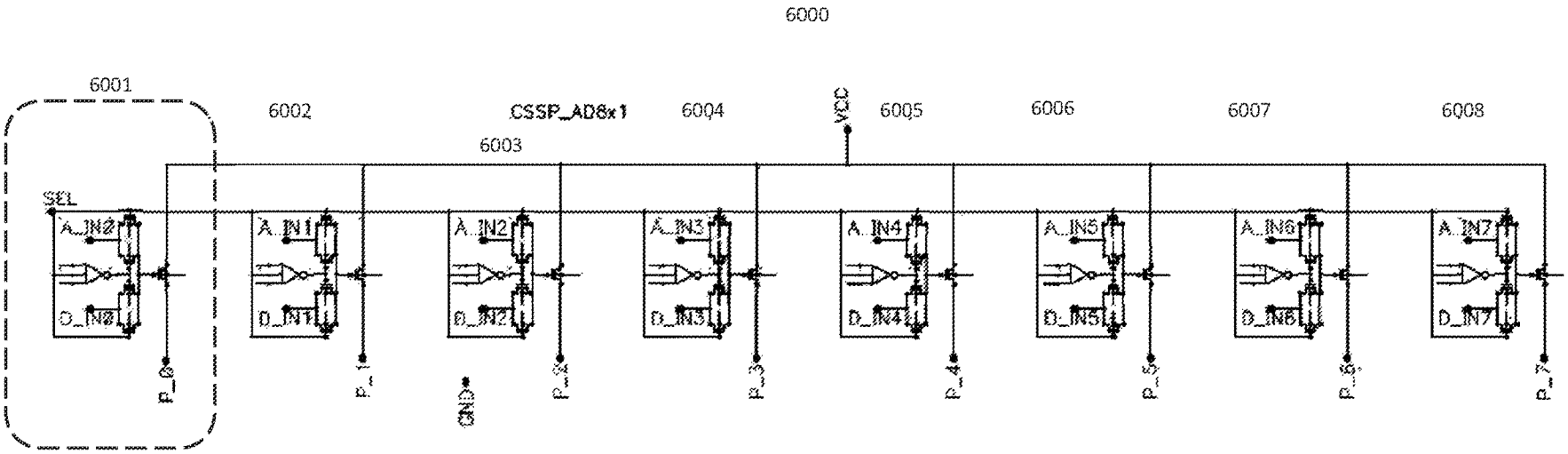

FIG. 6 illustrates the details of anode side sub block CSSP_AD8×1 6000 connected between VCC and CSSP_32×32×4. CSSP_AD8×1 includes 8 AD modules 6001, 6002, . . . , 6007 and 6008. Each of the eight anode pins (P_0 to P_7) of the AD modules 6001-6008 are connected to the same voltage power source VCC. Each is also connected to its respective analog input A_IN and digital input D_IN. The SEL input pin enables the selection between the output of this sub block are either an analog current source or a digital scan signal. At any given time, only one of the analog input and the digital input is connected to the anode pin. According to one embodiment, the anode side sub block CSSP_AD8×1 6000 is part of the anode side channel scan switching block 1100 illustrated in FIG. 1, with VCC connected to the VCC of the anode side channel scan switching block 1100, and with the SEL connected to the CSS_SEL of the controller 1400.

Figure 7A:
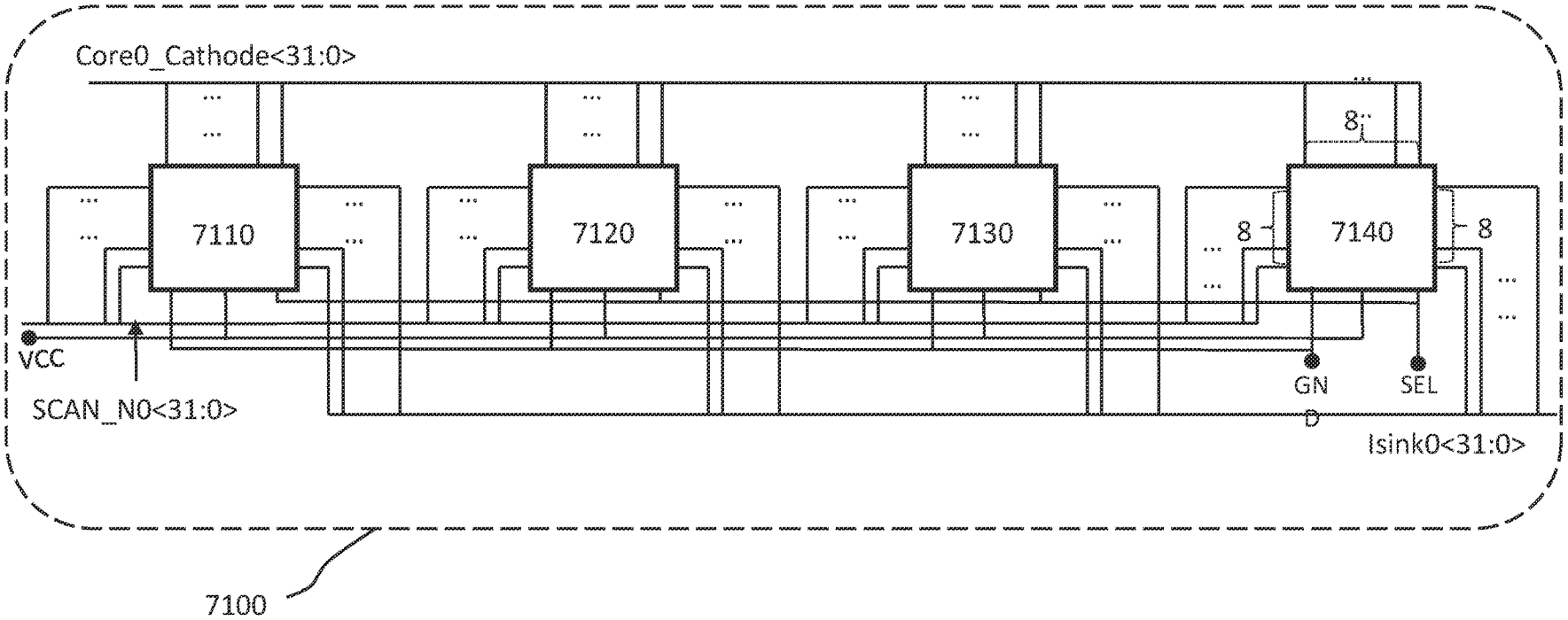
FIGS. 7A and 7B illustrate examples of cathode side channel scan switch on 32×32 cores core0 through core3 in the common cathode configuration illustrated in FIG. 1.
Figure 7B:
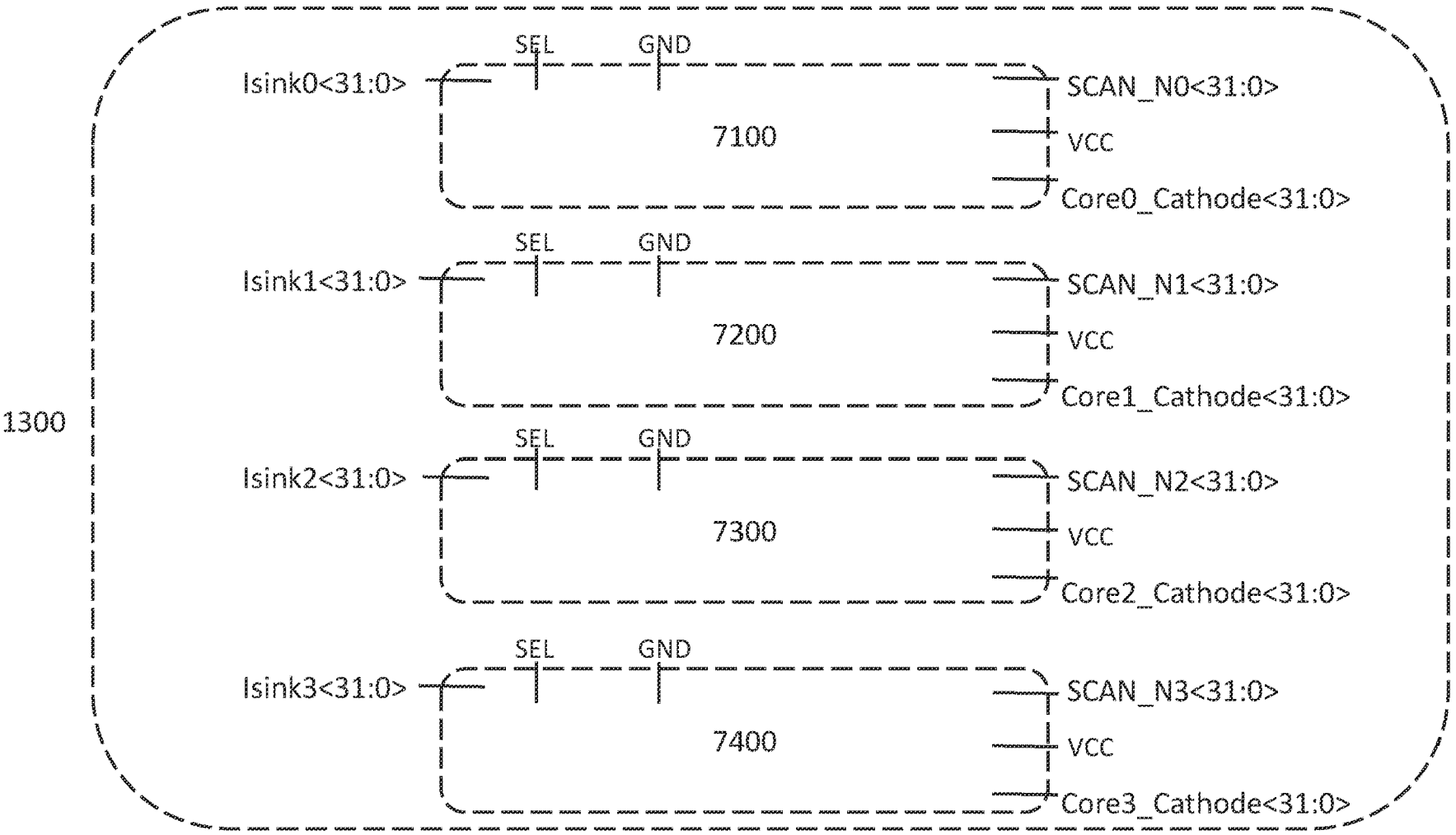

FIGS. 7A and 7B illustrate the details of the cathode side channel scan switch control block 1300 illustrated in FIG. 1. Block 1300 contains 4 cores, namely 7100, 7200, 7300 and 7400, of 32×32 cathode side channel scan switching circuit. Each core includes four sub-units. As illustrated in FIG. 7A, the first core 7100 includes four sub-units 7110, 7120, 7130, and 7140. Each core receives 32 digital scan input signals, 32 analog current sink control input signals, and 32 cathode output signals. Since the anode block 1100 enables scan swap arrangement to achieve anti-blooming function, the digital scan sequence is the same as current sink signal sequence. The configuration of the four cores 7100, 7200, 7300 and 7400 mirrors to the configuration of the four cores 2100, 2200, 2300 and 2400 as illustrated in FIG. 2B. Similarly, the configurations of the sub-units 7110, 7120, 7130 and 7140 are also mirrors the configuration of the sub-units 2110, 2120, 2130 and 2140 as illustrated in FIG. 2A, with some important differences.

In the cathode side channel scan switch 1300 as illustrated in FIGS. 7A and 7B, there are four cathode cores 7100, 7200, 7300 and 7400. Each core is connected to 32 current sinks, IsinkX<31:0>, 32 cathode scan lines Scan_PX<31:0>, and 32 cathode pins through CoreX_Cathode<31:0>. In the scan mode, all cathodes are driven by current sink control inputs. The cathode connection sequence is the same as the current sink sequence, i.e., CoreX_Cathode<31:0>=IsinkX<31:0>. In strobe mode, all cathodes are driven by scan control inputs while the cathode connection sequence is the same as the scan sequence, i.e., CoreX_Cathode<31:0>=ScanX<31:0>.

Figure 8:
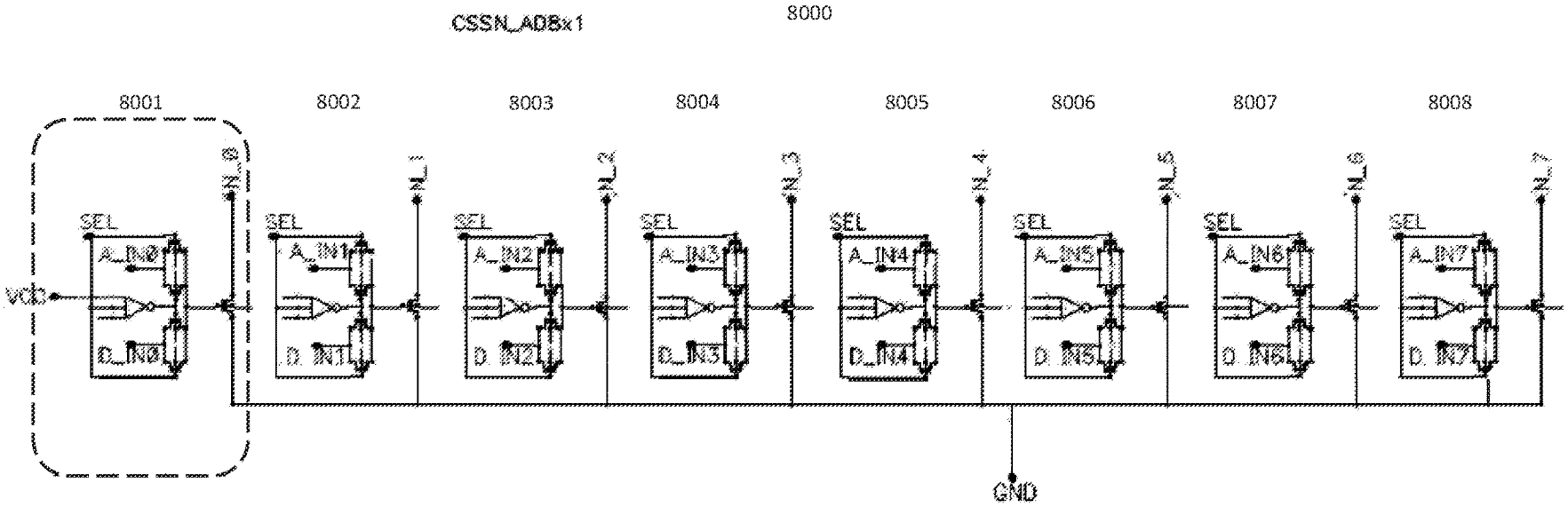

FIG. 8 illustrates an example of the channel scan switch CSSN_AD8×1 8000 for 8 cathode pins in the common anode configuration illustrated in FIG. 1. FIG. 8 shows how the cathode pins are switched between the scan mode and the strobe mode. The channel scan switch for 8 cathode pins include 8 AD modules 8001, 8002, . . . , 8007 and 8008. Each of the eight cathode pins (N_0 to N_7) of the AD modules 8001-8008 are connected to a ground GND as well as an analog input A_IN and a digital input D_IN. At any given time, only one of the analog input and the digital input is connected to the anode pin. FIG. 8 shows how the cathode pins (N_0 to N_7) are switchable from receiving digital scan inputs D_IN and receiving analog channel current sink inputs A_IN. According to one embodiment, the cathode side sub block CSSN_AD8×1 8000 is part of the cathode side channel scan switching block 1300 illustrated in FIG. 1, with GND connected to the GND of the cathode side channel scan switching block 1300, and with the SEL connected to the CSS_SEL of the controller 1400.

Figure 9:
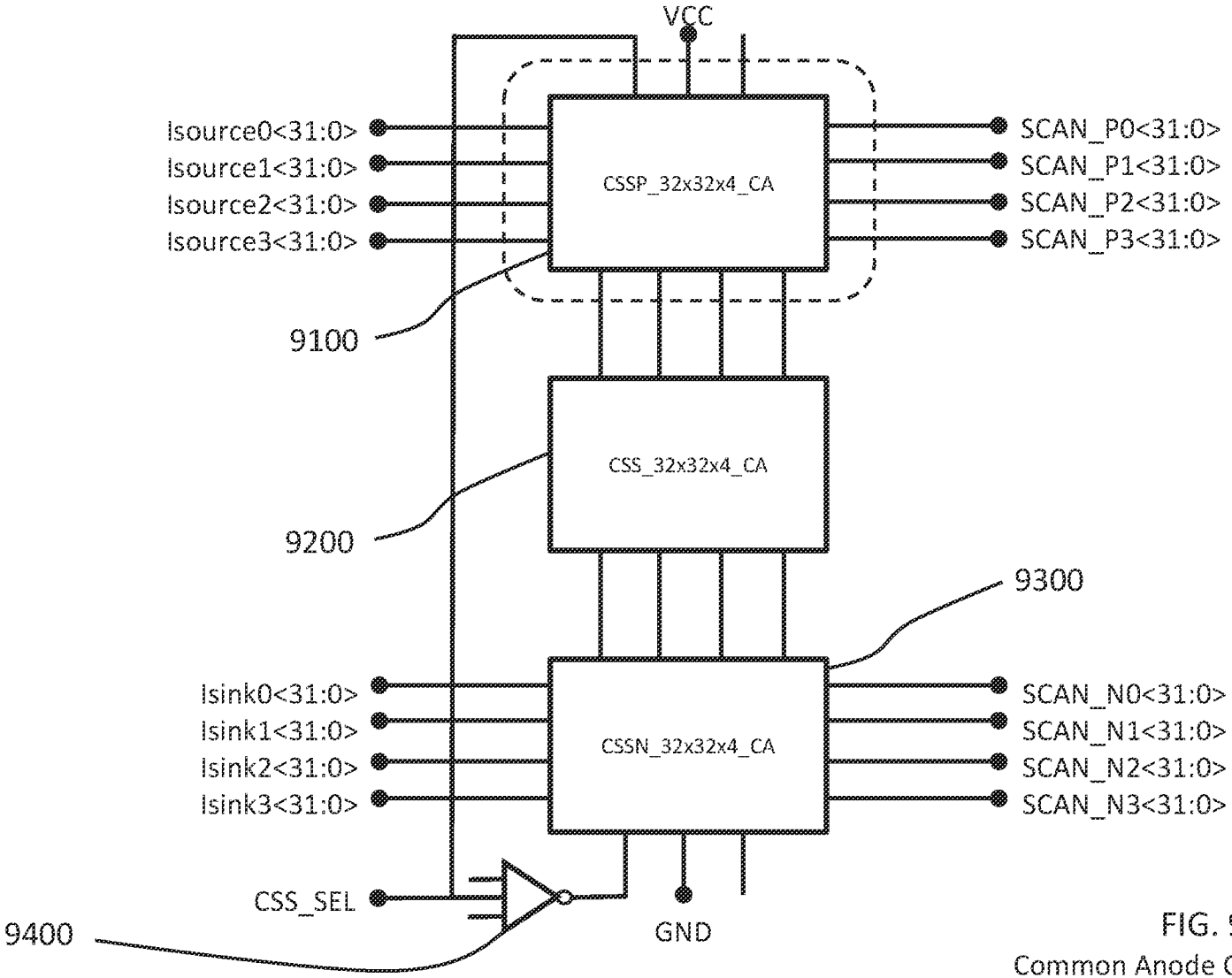

While FIGS. 1 through 8 illustrates an LED system arranged in common cathode configuration, FIGS. 9 through 14B illustrates an LED system arranged in a common anode configuration, respectively. For example, FIG. 1 and FIG. 9 illustrate similar structures, the difference is that FIG. 1 is in the common cathode configuration, while FIG. 9 is in the common anode configuration. Similarly, FIGS. 2A, 2B and FIGS. 10A, 10B illustrate similar structures, the difference is that FIGS. 2A, 2B are in the common cathode configuration, while FIGS. 10A and 10B are in the common anode configuration. The rest of FIGS. 3-5, 7A and 7B correspond to FIGS. 11-13, 14A and 14B, respectively.

Table 1 illustrates how the LEDs are lit in four anode cores in FIG. 2, also referred to as scan assignment or lighting sequence. The 32 pins in each CoreX_Anode<31:0> are connected to a matrix of 32×32 LEDs, only one pin receives a scan digital signal at one time so that only one in 32 LEDs is lit at any given time, thus reducing blooming. Further, the scan assignment algorithm in this embodiment creates a pattern that LEDs are lit consecutively but are spread out in different areas of the LED array. This algorithm ensures that LEDs in one small cluster are not consecutively lit in one area while LEDs in another area stay dark for an extended period of time. For example, LED in the first eight columns (Y=0-7) are lit in a sequence from 0 to 31. The even numbers are in columns 0 to 3 while odd numbers are in columns 4 to 7, which ensures one LED in columns 0 to 3 is lit, followed by lighting one LED in columns 4 to 7. LEDs within columns 0-3 are lit in a way that each column has one lit LED in one cycle, e.g., 0, 2, 4, 6, then 8, 10, 12, 14. The algorithm may be adjusted to accomplish the scan assignment to optimize the visual effect.

TABLE 1

| | Anode<Y> | | | | | | | | | | |
|---|---|---|---|---|---|---|---|---|---|---|---|
| CoreX_ | <0> | <1> | <2> | <3> | <4> | <5> | <6> | <7> | <8> | <9> | <10> |
| Core0 | 0 | 16 | 8 | 24 | 1 | 17 | 9 | 25 | 2 | 18 | 10 |
| Core1 | 10 | 26 | 2 | 18 | 11 | 27 | 3 | 19 | 12 | 28 | 4 |
| Core2 | 20 | 4 | 28 | 12 | 21 | 5 | 29 | 13 | 22 | 6 | 30 |
| Core 3 | 30 | 14 | 22 | 6 | 31 | 15 | 23 | 7 | 0 | 16 | 24 |

| | Anode<Y> | | | | | | | | | |
|---|---|---|---|---|---|---|---|---|---|---|
| CoreX_ | <11> | <12> | <13> | <14> | <15> | <16> | <17> | <18> | <19> | <20> |
| Core0 | 26 | 3 | 19 | 11 | 27 | 4 | 20 | 12 | 28 | 5 |
| Core1 | 20 | 13 | 29 | 5 | 21 | 14 | 30 | 6 | 22 | 15 |
| Core2 | 14 | 23 | 7 | 31 | 15 | 24 | 8 | 0 | 16 | 25 |
| Core3 | 8 | 1 | 17 | 25 | 9 | 2 | 18 | 26 | 10 | 3 |

TABLE 1-continued

| | Anode<Y> | | | | | | | | | | |
|---|---|---|---|---|---|---|---|---|---|---|---|
| CoreX_ | <21> | <22> | <23> | <24> | <25> | <26> | <27> | <28> | <29> | <30> | <31> |
| Core0 | 21 | 13 | 29 | 6 | 22 | 14 | 30 | 7 | 23 | 15 | 31 |
| Core1 | 31 | 7 | 23 | 16 | 0 | 8 | 24 | 17 | 1 | 9 | 25 |
| Core2 | 9 | 1 | 17 | 26 | 10 | 2 | 18 | 27 | 11 | 3 | 19 |
| Core3 | 19 | 27 | 11 | 4 | 20 | 28 | 12 | 5 | 21 | 29 | 13 |

TABLE 2

| | CoreX_ A<0> | CoreX_ A<1> | CoreX_ A<2> | CoreX_ A<3> | CoreX_ A<4> | CoreX_ A<5> | CoreX_ A<6> | CoreX_ A<7> | |
|---|---|---|---|---|---|---|---|---|---|
| X = 0 | 0 | 16 | 8 | 24 | 1 | 17 | 9 | 25 | Core0_Cathode<0> |
| X = 1 | 30 | 14 | 22 | 6 | 31 | 15 | 23 | 7 | Core1_Cathode<0> |
| X = 2 | 2 | 18 | 10 | 26 | 3 | 19 | 11 | 27 | Core2_Cathode<0> |
| X = 3 | 28 | 12 | 20 | 4 | 29 | 13 | 21 | 5 | Core3_Cathode<0> |
| X = 0 | 0 | 16 | 8 | 24 | 1 | 17 | 9 | 25 | Core0_Cathode<1> |
| X = 1 | 30 | 14 | 22 | 6 | 31 | 15 | 23 | 7 | Core1_Cathode<1> |
| X = 2 | 2 | 18 | 10 | 26 | 3 | 19 | 11 | 27 | Core2_Cathode<1> |
| X = 3 | 28 | 12 | 20 | 4 | 29 | 13 | 21 | 5 | Core3_Cathode<1> |

Table 2 shows an exemplary lighting sequence for LEDs in two of the 4×8 base LED arrays. FIG. 5 shows one such 4×8 base array. FIG. 4 shows one row of 4 base array shown in FIG. 5 while FIG. 3 shows 32 rows of FIG. 4 from top to bottom. The two base arrays shown in Table 2 are in the top left corner of the arrangement in FIG. 3. CoreX_A<0> designates the column of LEDs connected to anode core number X, channel 0. Core0_Cathode<0> means the row of LEDs are connected to cathode core 0, line 0.

The total of 64 LEDs are divided into four LED groups that are 4×4 in size. Each base array is arranged so that two groups of 4×4 LEDs on the left only receive scan signals when the scan assignments are even numbers (hence "even-number LEDs") and two groups of 4×4 LEDs on the right only receive scan signals when the scan assignments are odd numbers (hence "odd-number LEDs"). During one image frame, even number LEDs and odd number LEDs are sequentially driven and alternately lit. Accordingly, at any given time, only one LED in the two adjacent 4×4 groups of LEDs is lit, one among 4×4 even-number LEDs followed by one among the 4×4 odd-number LEDs are lit. As such, only one in 32 LEDs is lit at any given moment, thereby reducing the blooming effect.

Reducing flickering only requires that the LEDs in a local area (e.g., 4×4) to be ON at a sufficiently high frequency (e.g. 60 Hz or higher). However, when more than one in LEDs in the local area (e.g., 4×4) are ON, there may be a blooming effect. Embodiments in this disclosure enables only one LED to be ON in a local area, thus not only reducing flickering but also reducing blooming.

The embodiments FIGS. 1-7B have a 32 scan by 32 channel configurations. Other configurations are possible. For example, the scan number and the channel numbers need not be the same, e.g. 16 scan by 32 channel. However, in such a configuration, some of the pins would necessarily assigned only to be connected to a scan line or to a channel, thereby serving only one function. Further, the scan number or the channel number can be larger or smaller than 32. Smaller scan/channel numbers would enable more refined control of LEDs, which would also increase cost as well as the footprint on the driver because more pins and connections are needed to drive the same number of LEDs. Larger scan/channel numbers would further reduce the number of pins but would require higher frequency switches.

Figure 10A:
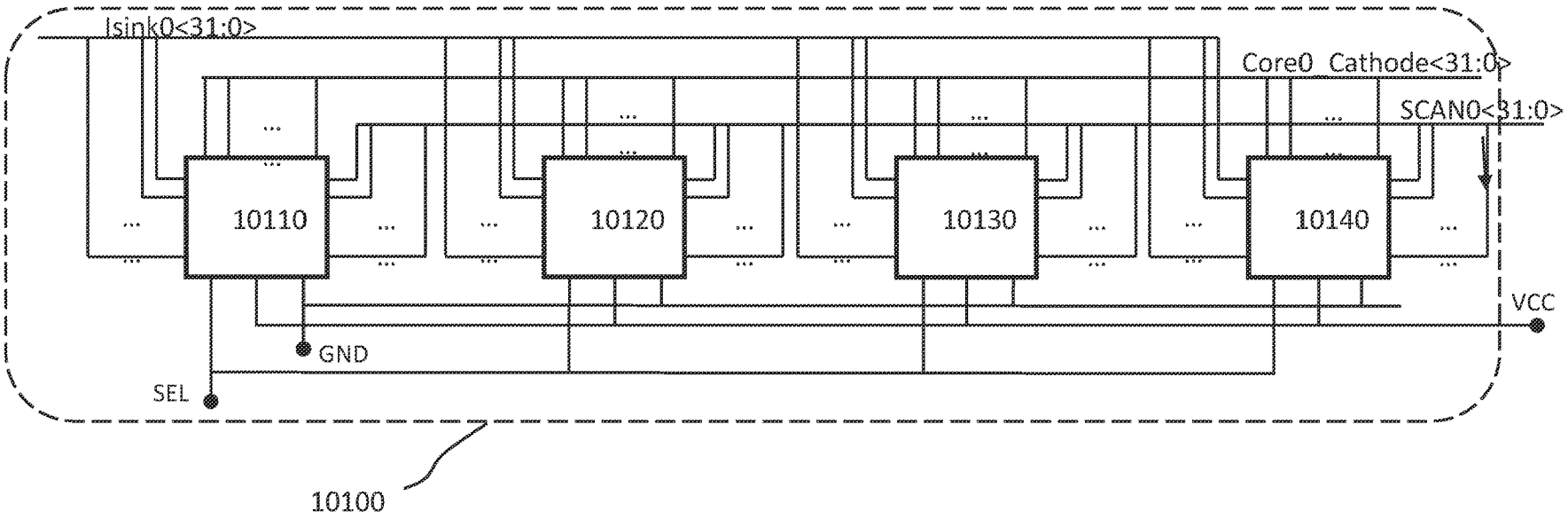
Figure 10B:
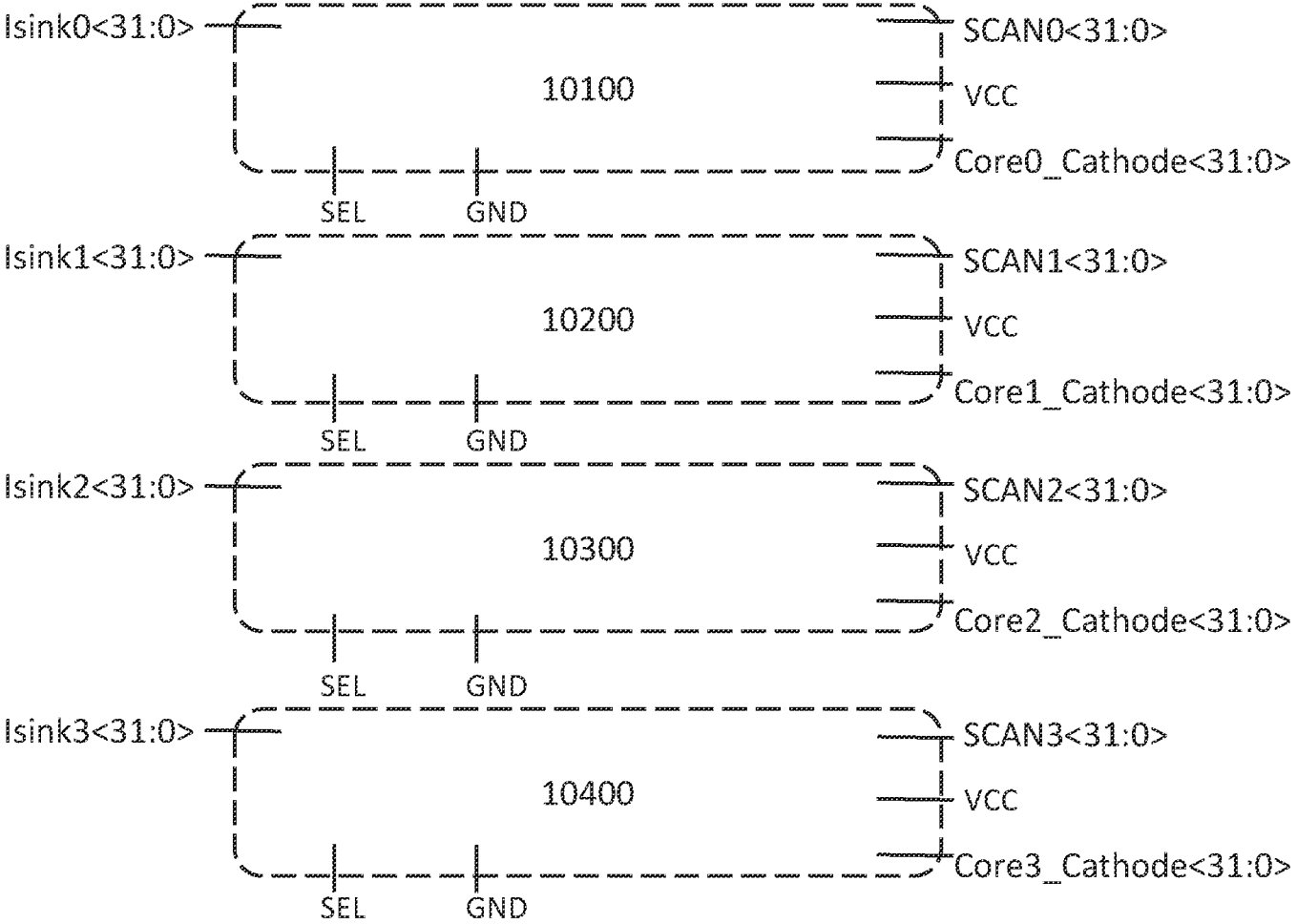

In other embodiments of this disclosure, the based LED array in the LED block can be in a common anode configuration. In such an embodiment, connections for the cathode block and the anode block change accordingly. The CSSN_32×32×4 block internal pin sequence in common anode configuration is the same as CSSP_32×32×4 block internal pin sequence in common cathode configuration. The CSSP_32×32×4 block internal pin sequence in common anode configuration is the same as CSSN_32×32×4 block internal pin sequence in common cathode configuration. As stated above, FIGS. 9-14B illustrate in details the common anode configuration. For example, FIG. 1 and FIG. 9 illustrate similar structures, the difference is that FIG. 1 is in the common cathode configuration, while FIG. 9 is in the common anode configuration. Similarly, FIGS. 2A, 2B and FIGS. 10A, 10B illustrate similar structures, the difference is that FIGS. 2A, 2B are in the common cathode configuration, while FIGS. 10A and 10B are in the common anode configuration. The rest of FIGS. 3-5, 7A and 7B correspond to FIGS. 11-13, 14A and 14B, respectively. Components in the common anode configuration is sometime named with the suffix of "CA" or "_CA" attached to the name applied to similar components in a common cathode configuration.

Figure 13:
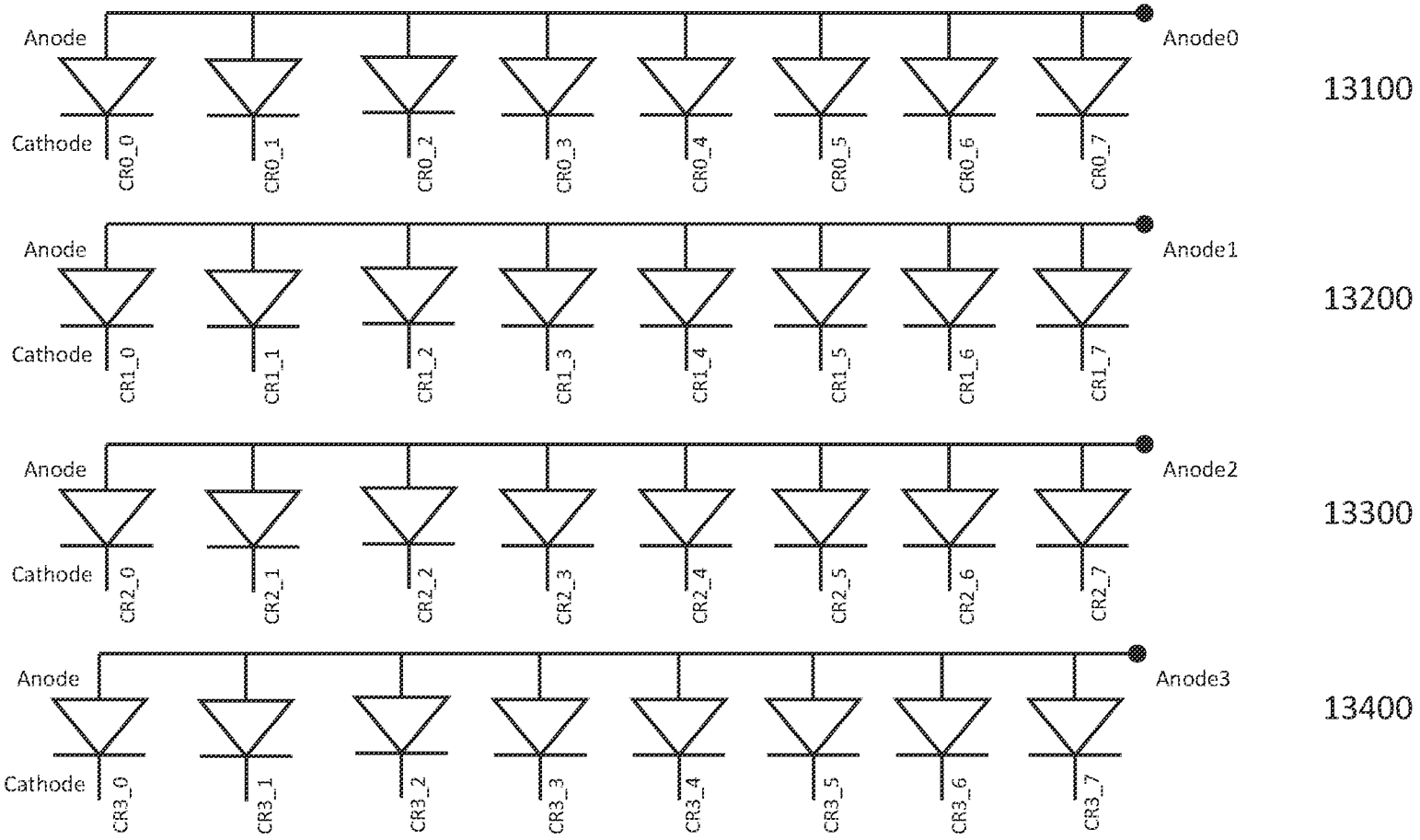

In the common anode configuration, the anode side CSS sub block CSSP_AD8×1 of FIG. 6 is connected to CSSP_32×32×4 CA in FIGS. 1 and 2A, 2B. Likewise, the cathode side CSS sub block CSSN_AD8×1 in FIG. 13 is connected to CSSN_32×32×4_CA, as shown in FIGS. 9 and 10A, 10B.

FIGS. 10A and 10B illustrates the details of the anode side CSS control block(CSSP_32×32×4_CA) 8100 in common anode configuration in FIG. 9. In the strobe common delay mode, all cathodes are driven by current sink control inputs, and the cathode connection sequence is the same as the current sink sequence: CoreX_Cathode<31:0>=IsinkX<31:0>. In the static anti-blooming scan mode, all cathodes are driven by scan control inputs, and in order to ensure only one LED s turned on among the adjacent LEDs, each core scan input sequence is grouped differently to ensure that in the 8×4 LED arrays, only one LED is turned on at any given time.

The assignments of cathode pins in the scan mode are detailed below:

Core0 static anti-blooming scan pin assignment:

Core0_Cathode<31>=SCAN_N0<31>
Core0_Cathode<30>=SCAN_N0<15>
Core0_Cathode<29>=SCAN_N0<23>
Core0_Cathode<28>=SCAN_N0<7>
Core0_Cathode<27>=SCAN_N0<30>
Core0_Cathode<26>=SCAN_N0<14>
Core0_Cathode<25>=SCAN_N0<22>
Core0_Cathode<24>=SCAN_N0<6>
Core0_Cathode<23>=SCAN_N0<29>
Core0_Cathode<22>=SCAN_N0<13>
Core0_Cathode<21>=SCAN_N0<21>
Core0_Cathode<20>=SCAN_N0<5>
Core0_Cathode<19>=SCAN_N0<28>
Core0_Cathode<18>=SCAN_N0<12>
Core0_Cathode<17>=SCAN_N0<20>
Core0_Cathode<16>=SCAN_N0<4>
Core0_Cathode<15>=SCAN_N0<27>
Core0_Cathode<14>=SCAN_N0<11>
Core0_Cathode<13>=SCAN_N0<19>
Core0_Cathode<12>=SCAN_N0<3>
Core0_Cathode<11>=SCAN_N0<26>
Core0_Cathode<10>=SCAN_N0<10>
Core0_Cathode<9>=SCAN_N0<18>
Core0_Cathode<8>=SCAN_N0<2>
Core0_Cathode<7>=SCAN_N0<25>
Core0_Cathode<6>=SCAN_N0<9>
Core0_Cathode<5>=SCAN_N0<17>
Core0_Cathode<4>=SCAN_N0<1>
Core0_Cathode<3>=SCAN_N0<24>
Core0_Cathode<2>=SCAN_N0<8>
Core0_Cathode<1>=SCAN_N0<16>
Core0_Cathode<0>=SCAN_N0<0>.

Core1 static anti-blooming scan pin assignment:

Core1_Cathode<31>=SCAN_N0<25>
Core1_Cathode<30>=SCAN_N0<9>
Core1_Cathode<29>=SCAN_N0<1>
Core1_Cathode<28>=SCAN_N0<17>
Core1_Cathode<27>=SCAN_N0<24>
Core1_Cathode<26>=SCAN_N0<8>
Core1_Cathode<25>=SCAN_N0<0>
Core1_Cathode<24>=SCAN_N0<16>
Core1_Cathode<23>=SCAN_N0<23>
Core1_Cathode<22>=SCAN_N0<7>
Core1_Cathode<21>=SCAN_N0<31>
Core1_Cathode<20>=SCAN_N0<15>
Core1_Cathode<19>=SCAN_N0<22>
Core1_Cathode<18>=SCAN_N0<6>
Core1_Cathode<17>=SCAN_N0<30>
Core1_Cathode<16>=SCAN_N0<14>
Core1_Cathode<15>=SCAN_N0<21>
Core1_Cathode<14>=SCAN_N0<5>
Core1_Cathode<13>=SCAN_N0<29>
Core1_Cathode<12>=SCAN_N0<13>
Core1_Cathode<11>=SCAN_N0<20>
Core1_Cathode<10>=SCAN_N0<4>
Core1_Cathode<9>=SCAN_N0<28>
Core1_Cathode<8>=SCAN_N0<12>
Core1_Cathode<7>=SCAN_N0<19>
Core1_Cathode<6>=SCAN_N0<3>
Core1_Cathode<5>=SCAN_N0<27>
Core1_Cathode<4>=SCAN_N0<11>
Core1_Cathode<3>=SCAN_N0<18>
Core1_Cathode<2>=SCAN_N0<2>
Core1_Cathode<1>=SCAN_N0<26>
Core1_Cathode<0>=SCAN_N0<10>.

Core2 static anti-blooming scan pin assignment:

Core2_Cathode<31>=SCAN_N0<19>
Core2_Cathode<30>=SCAN_N0<3>
Core2_Cathode<29>=SCAN_N0<11>
Core2_Cathode<28>=SCAN_N0<27>
Core2_Cathode<27>=SCAN_N0<18>
Core2_Cathode<26>=SCAN_N0<2>
Core2_Cathode<25>=SCAN_N0<10>
Core2_Cathode<24>=SCAN_N0<26>
Core2_Cathode<23>=SCAN_N0<17>
Core2_Cathode<22>=SCAN_N0<1>
Core2_Cathode<21>=SCAN_N0<9>
Core2_Cathode<20>=SCAN_N0<25>
Core2_Cathode<19>=SCAN_N0<16>
Core2_Cathode<18>=SCAN_N0<0>
Core2_Cathode<17>=SCAN_N0<8>
Core2_Cathode<16>=SCAN_N0<24>
Core2_Cathode<15>=SCAN_N0<15>
Core2_Cathode<14>=SCAN_N0<31>
Core2_Cathode<13>=SCAN_N0<7>
Core2_Cathode<12>=SCAN_N0<23>
Core2_Cathode<11>=SCAN_N0<14>
Core2_Cathode<10>=SCAN_N0<30>
Core2_Cathode<9>=SCAN_N0<6>
Core2_Cathode<8>=SCAN_N0<22>
Core2_Cathode<7>=SCAN_N0<13>
Core2_Cathode<6>=SCAN_N0<29>
Core2_Cathode<5>=SCAN_N0<5>
Core2_Cathode<4>=SCAN_N0<21>
Core2_Cathode<3>=SCAN_N0<12>
Core2_Cathode<2>=SCAN_N0<28>
Core2_Cathode<1>=SCAN_N0<4>
Core2_Cathode<0>=SCAN_N0<20>.

Core3 static anti-blooming scan pin assignment:

Core3_Cathode<31>=SCAN_N0<13>
Core3_Cathode<30>=SCAN_N0<29>
Core3_Cathode<29>=SCAN_N0<21>
Core3_Cathode<28>=SCAN_N0<5>
Core3_Cathode<27>=SCAN_N0<12>
Core3_Cathode<26>=SCAN_N0<28>
Core3_Cathode<25>=SCAN_N0<20>
Core3_Cathode<24>=SCAN_N0<4>
Core3_Cathode<23>=SCAN_N0<11>
Core3_Cathode<22>=SCAN_N0<27>
Core3_Cathode<21>=SCAN_N0<19>
Core3_Cathode<20>=SCAN_N0<3>
Core3_Cathode<19>=SCAN_N0<10>
Core3_Cathode<18>=SCAN_N0<26>
Core3_Cathode<17>=SCAN_N0<18>
Core3_Cathode<16>=SCAN_N0<2>
Core3_Cathode<15>=SCAN_N0<9>
Core3_Cathode<14>=SCAN_N0<25>
Core3_Cathode<13>=SCAN_N0<17>
Core3_Cathode<12>=SCAN_N0<1>
Core3_Cathode<11>=SCAN_N0<8>
Core3_Cathode<10>=SCAN_N0<24>
Core3_Cathode<9>=SCAN_N0<16>
Core3_Cathode<8>=SCAN_N0<0>
Core3_Cathode<7>=SCAN_N0<7>
Core3_Cathode<6>=SCAN_N0<23>
Core3_Cathode<5>=SCAN_N0<15>
Core3_Cathode<4>=SCAN_N0<31>
Core3_Cathode<3>=SCAN_N0<6>
Core3_Cathode<2>=SCAN_N0<22>
Core3_Cathode<1>=SCAN_N0<14>

Figure 11:
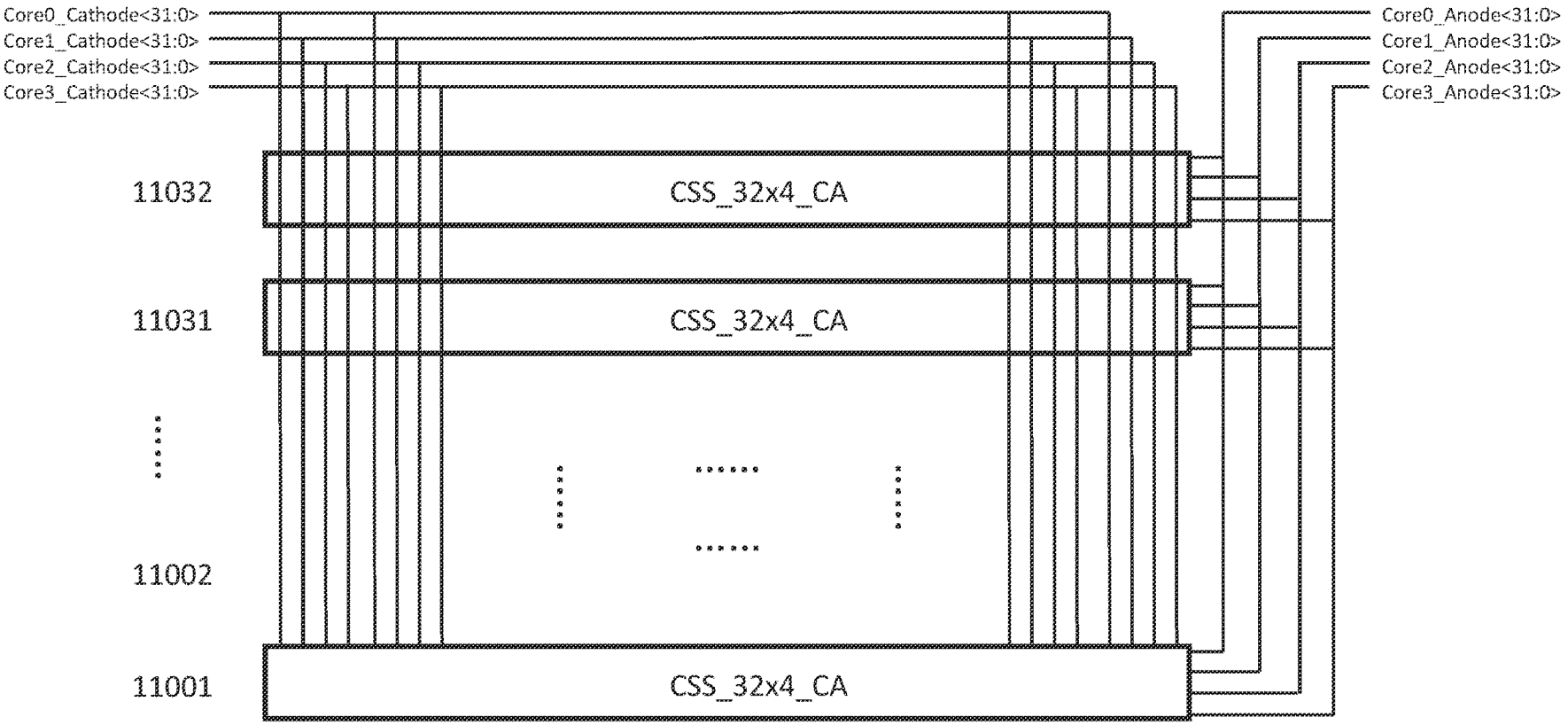

FIG. 11 illustrates an example of the CSS_32×32×4 LED block in the common anode configuration illustrated in FIG. 9. In the cathode side strobe common delay mode, the CoreX cathodes are connected to the CoreX current sink signals interleavedly. In the Cathode side static anti-blooming mode, the CoreX cathodes are connected to the CoreX channel scan signals interleavedly. In the anode side strobe common delay mode, the CoreX anodes are connected to the CoreX scan signals interleavedly. In the anode side static anti-blooming mode, the CoreX anodes are connected to the CoreX channel current source signals interleavedly.

The CSS_32×32×4 common anode channel scan switching array includes 32 blocks of 32×4_CA interleave sub arrays. The same cathode of each block is connected together with a total of 128 connections. There are four anode connections to each block and different anodes are driven by different cores interleavedly. A total of 128 anode connections drive a total 32 of blocks. The array includes a total of 4096 LEDs controlled by a total of 256 signals.

Figure 12A:
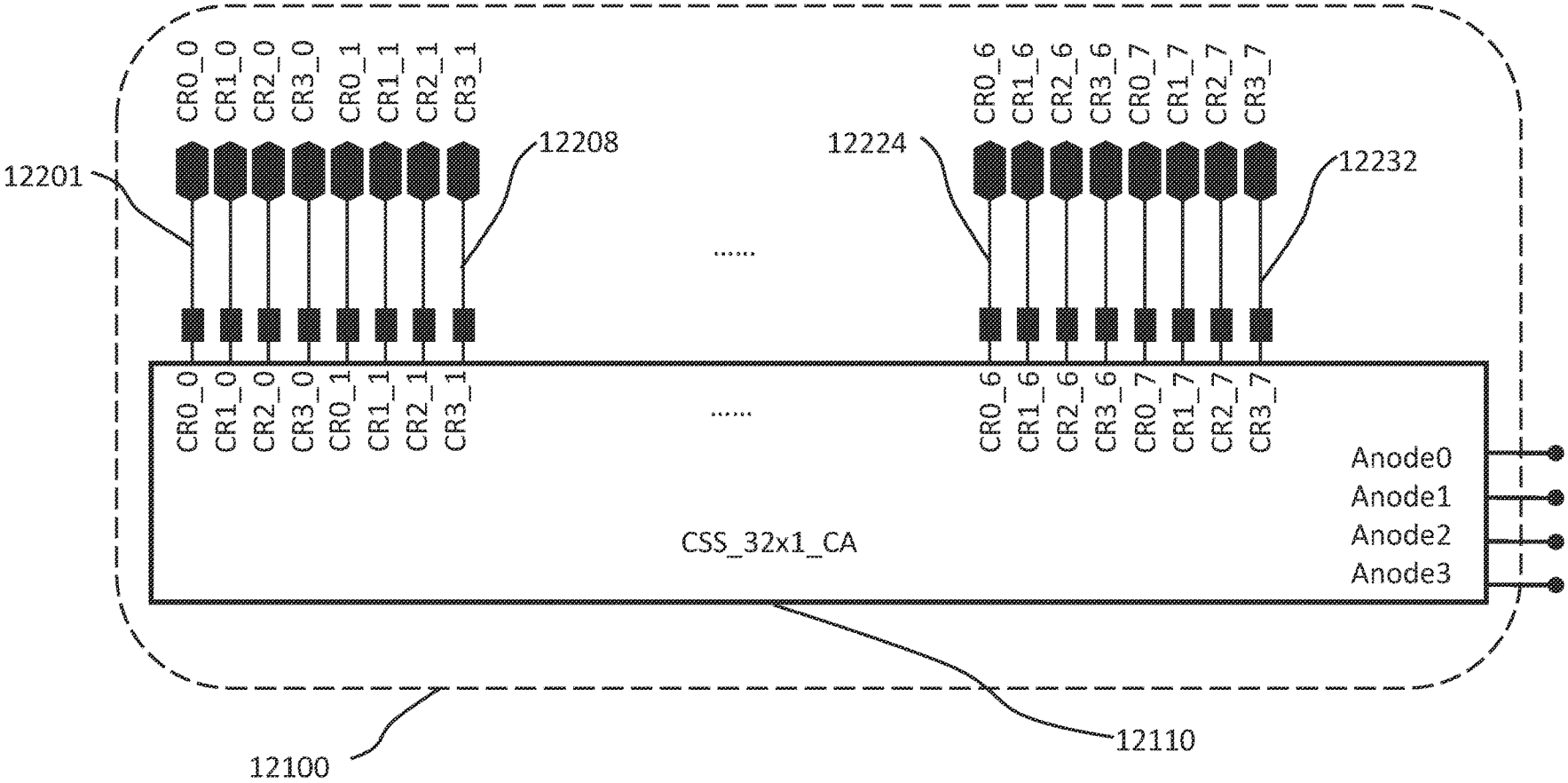
FIGS. 12A and 12B illustrate an example of common anode interleave structure.
Figure 12B:
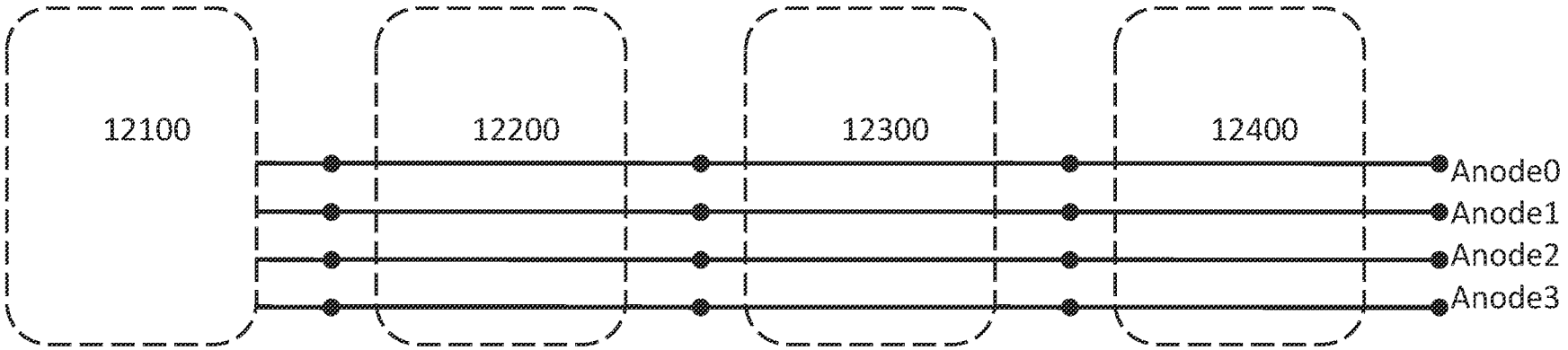

FIGS. 12A and 12B illustrate an example of the common anode interleave structure. The CSS_32×4_CA common anode interleave structure includes four blocks of CSS_32×1_CA, which share the same anode pin, but the cathodes pins are different. Each core provides one anode connection and 32 cathode connections.

FIG. 13 illustrates an example of CSS_32×1 common anode interleave switching element. In the strobe common delay mode, the AnodeX are driven by the CoreX scan signals, and the CathodeRowX are driven by the CoreX current signals. In the static anti-blooming scan mode, the AnodeX are driven by the CoreX current sources, and the CathodeX are driven by the CoreX scan signals, only one LED is turned on at any given time, each core provides 4 even and 4 odd scans, 16 different even scan on the left and 16 different odd scans on the right.

Figure 14A:
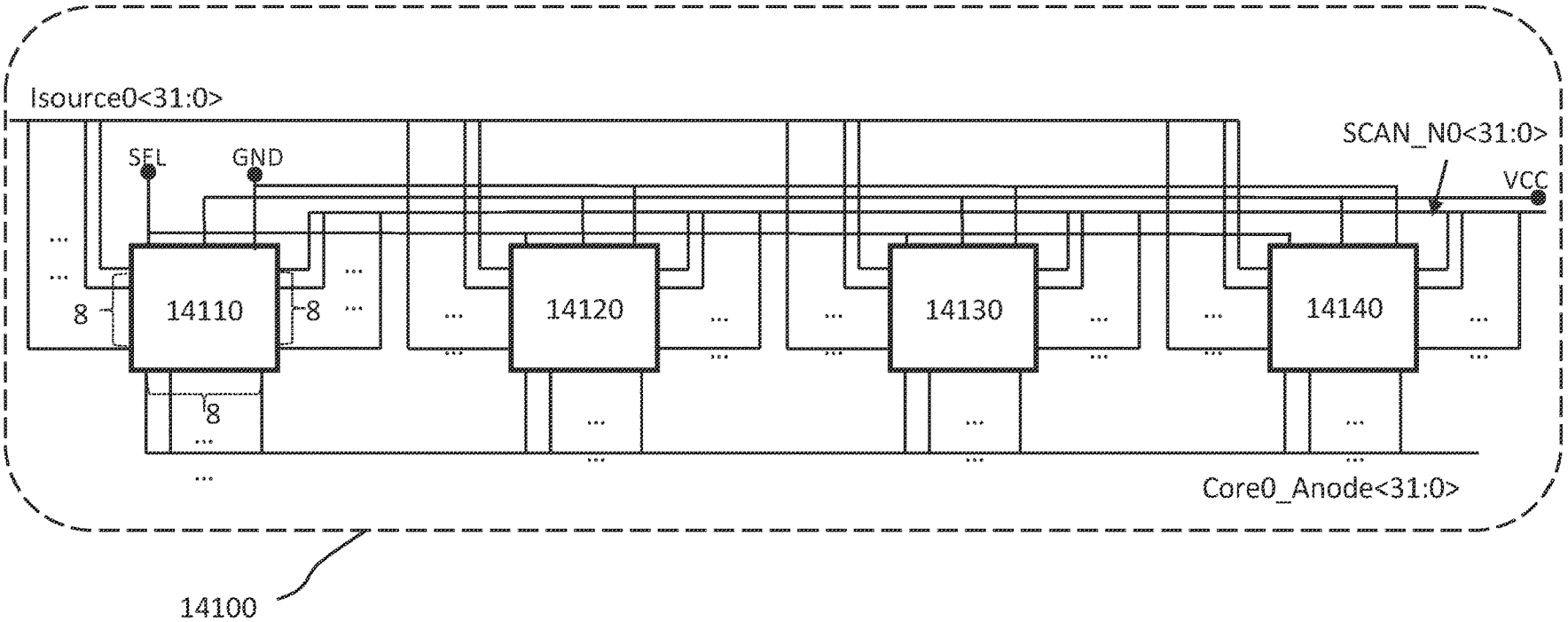
Figure 14B:
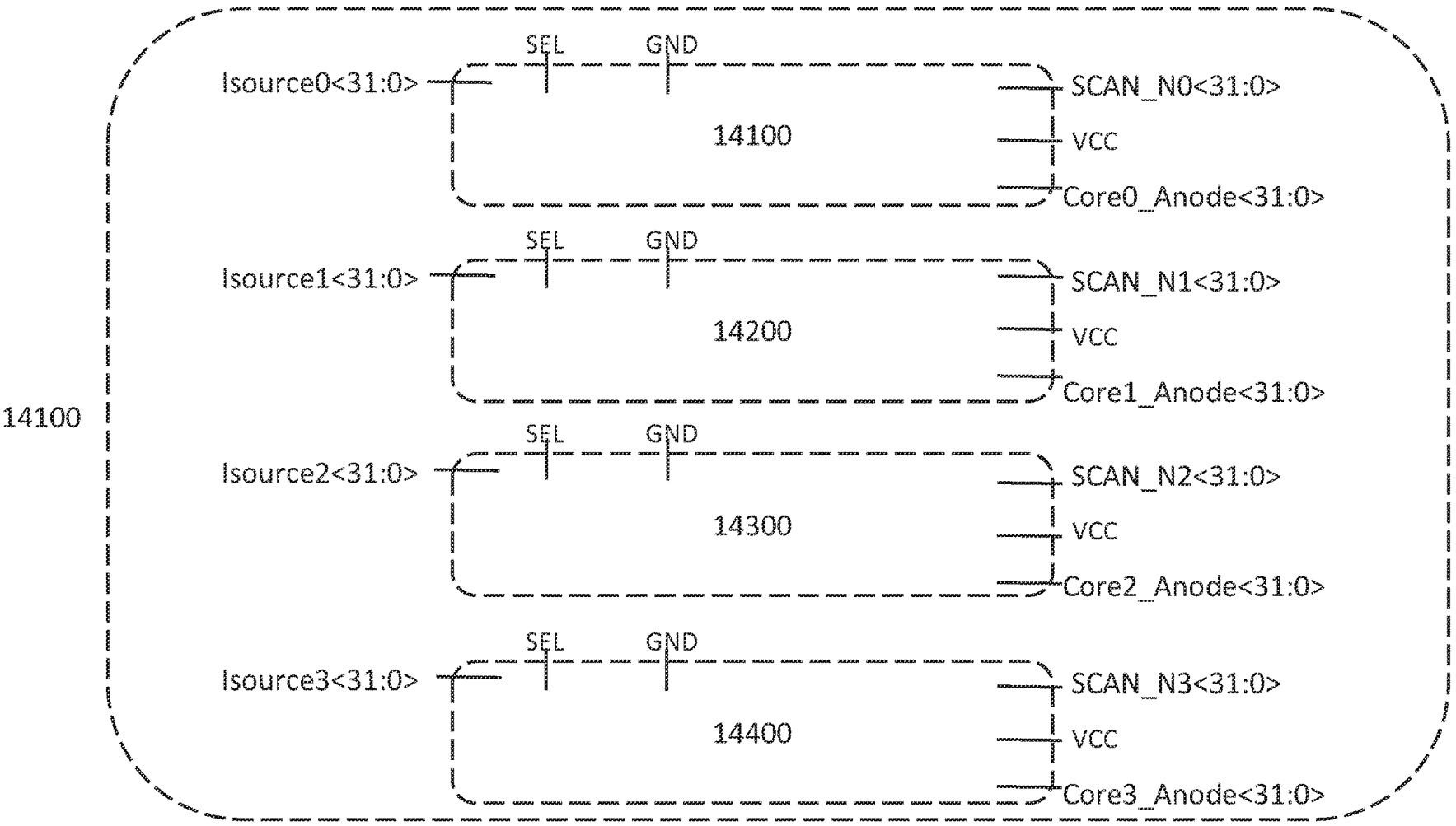

FIGS. 14A and 14B illustrate examples of cathode side channel scan switch on 32×32 cores core0 through core3 in the common anode configuration illustrated in FIG. 9. FIGS. 14A and 14B illustrate the details of the cathode side channel scan switch control block (CSSN_32×32×4_CA) 9300 illustrated in FIG. 9, which consists of 4 cores, namely 14100, 14200, 14300 and 14400, of 32×32 cathode side channel scan switching circuit. In the static anti-blooming scan mode, all anodes are driven by the current source control inputs, and the anode connection sequence is the same as the current source sequence: CoreX_Anode<31:0>=IsourceX<31:0>. In the strobe common delay mode, all anodes are driven by the scan control inputs, and the anode connection sequence is the same s scan sequence: CoreX_Anode<31:0>=Scan_NX<31:0>.

The building block in the common anode configuration are similar or the same as in the common cathode configuration. The significant difference is that LEDs are connected to a common anode node rather than to a common cathode node. For example, the base array in FIG. 12 still has the 4×8 array of LEDs. On the other hand, the anode of eight LEDs in a row is connected to a common anode node.

In still other embodiments, the number of channels and the number of scan lines may be other than 32, e.g., 16, the number of pins will change accordingly. Further the channel number and the scan number may be different.

In further embodiments, the circuit that enables the connection switch between analog input (current source or current sink) and digital scan input may be different.

In summary, the current disclosure provides an LED system in which connection pins can be switched between receiving digital scan input and receiving analog inputs. Further, the LED system has multiple anode cores (modules driving anode of LEDs), multiple cathode cores (modules driving cathode of LEDs), and an LED array consisting of multiple base arrays. Each base array has interleaved LED rows controlled by different cores. The multicore and interleaving features allow one LED in a small group of LEDs to lit in any given time, therefore not only reducing flickering but also reducing blooming.

We claim:

1. An LED display device, comprising:

at least one display units, wherein each of the at least one display units further comprises an LED array of L×M×N LEDs driven by N cores of channel scan switching;

an anode side switching circuit for anode side channel scan switching with M×N current source analog inputs and M×N digital scan inputs, wherein the anode side switching circuit is switchably connected to M×N current sources and M×N scan lines;

a cathode side switching circuit for cathode side channel scan switching with M×N current sink analog inputs and M×N digital scan inputs, wherein the cathode side switching circuit is switchably connected to M×N current sinks and M×N scan lines; and a controller having:

a first selection circuit connected to M×N current sources and M×N scan lines, wherein the first selection circuit is configured to select at least one current source from the M×N current sources and at least one scan line from the M×N scan lines in the anode side switching circuit; and a second selection circuit connected to M×N current sinks and M×N scan lines, wherein the second selection circuit is configured to select at least one current sink from the M×N current sinks and at least one scan line from the M×N scan lines in the cathode side switching circuit.

2. The LED display device of claim 1, wherein one of the at least two modes of the controller is a static anti-blooming scan mode.

3. The LED display device of claim 1, wherein the other one of the at least two modes of the controller is a strobe motion blur removal mode.

4. The LED display device of claim 2, wherein when the first selection circuit and the second selection circuit are both switched to the static anti-blooming scan mode, all anodes are driven by the scan control inputs.

5. The LED display device of claim 3, wherein when the first selection circuit and the second selection circuit are both switched to the strobe motion blur removal mode, all anodes are driven by the current source control inputs.

6. The LED display device of claim 2, wherein when the first selection circuit and the second selection circuit are both switched to the static anti-blooming scan mode, CoreX cathodes are connected to corresponding CoreX channel current sink signals interleavedly.

7. The LED display device of claim 3, wherein when the first selection circuit and the second selection circuit are both switched to the strobe motion blur removal mode, CoreX cathodes are connected to corresponding CoreX scan signals interleavedly.

8. The LED display device of claim 2, wherein when the first selection circuit and the second selection circuit are both switched to the static anti-blooming scan mode, all cathodes are driven by the current sink control inputs.

9. The LED display device of claim 3, wherein when the first selection circuit and the second selection circuit are both switched to the strobe motion blur removal mode, all cathodes are driven by the scan control inputs.

10. The LED display device of claim 1, wherein the LED display device common anode configuration.

11. The LED display device of claim 1, wherein the LED display device common cathode configuration.

12. A method for controlling an LED display device switchable between at least two modes, comprising:

deploying at least one display units, wherein each of the at least one display units further comprises an LED array of L×M×N LEDs driven by N cores of channel scan switching;

deploying an anode side switching circuit for anode side channel scan switching with M×N current source analog inputs and M×N digital scan inputs by at least switchably connecting the anode side switching circuit with M×N current sources and M×N scan lines;

deploying a cathode side switching circuit for cathode side channel scan switching with M×N current sink analog inputs and M×N digital scan inputs by at least switchably connecting the cathode side switching circuit with M×N current sinks and M×N scan lines;

deploying a first selection circuit connected to M×N current sources and M×N scan lines by selecting at least one current source from the M×N current sources and at least one scan line from the M×N scan lines in the anode side switching circuit; and deploying a second selection circuit connected to M×N current sinks and M×N scan lines by selecting at least one current sink from the M×N current sinks and at least one scan line from the M×N scan lines in the cathode side switching circuit.

13. The method for controlling the LED display device of claim 12, further comprises configuring the LED display device in a common anode configuration.

14. The method for controlling the LED display device of claim 12, further comprises configuring the LED display device in a common cathode configuration.

15. The method for controlling the LED display device of claim 12, further comprises: driving all anodes with the scan control inputs when the first selection circuit and the second selection circuit are both switched to a static anti-blooming scan mode.

16. The method for controlling the LED display device of claim 12, further comprises: driving all anodes with the current source control inputs when the first selection circuit and the second selection circuit are both switched to the strobe motion blur removal mode.

17. The method for controlling the LED display device of claim 12, further comprises: connecting CoreX cathodes to corresponding CoreX channel current sink signals interleavedly when the first selection circuit and the second selection circuit are both switched to the static anti-blooming scan mode.

18. The method for controlling the LED display device of claim 12, further comprises: connecting CoreX cathodes to corresponding CoreX scan signals interleavedly when the first selection circuit and the second selection circuit are both switched to the strobe motion blur removal mode.

19. The method for controlling the LED display device of claim 12, further comprises: driving all cathodes with the current sink control inputs when the first selection circuit and the second selection circuit are both switched to the static anti-blooming scan mode.

20. The method for controlling the LED display device of claim 12, further comprises: driving all cathodes with the scan control inputs when the first selection circuit and the second selection circuit are both switched to the strobe motion blur removal mode.

* * * * *